US009068754B2

(12) United States Patent
Hirano et al.

(10) Patent No.: US 9,068,754 B2
(45) Date of Patent: Jun. 30, 2015

(54) COOKING DEVICE

(75) Inventors: Seiichi Hirano, Osaka (JP); Mitsuo Ohuchi, Osaka (JP); Masayuki Iwamoto, Osaka (JP); Hiroshi Hirano, Osaka (JP); Shinji Asami, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 716 days.

(21) Appl. No.: 13/387,624

(22) PCT Filed: Jul. 30, 2010

(86) PCT No.: PCT/JP2010/062902

§ 371 (c)(1),
(2), (4) Date: Jan. 27, 2012

(87) PCT Pub. No.: WO2011/013801

PCT Pub. Date: Feb. 3, 2011

(65) Prior Publication Data

US 2012/0118169 A1 May 17, 2012

(30) Foreign Application Priority Data

Jul. 30, 2009 (JP) ..... 2009-177828
Oct. 23, 2009 (JP) ..... 2009-244504

(51) Int. Cl.
*A47J 37/12* (2006.01)
*F24C 15/00* (2006.01)
*F24C 15/20* (2006.01)

(52) U.S. Cl.
CPC ..... *F24C 15/2007* (2013.01); *F24C 15/006* (2013.01)

(58) Field of Classification Search
CPC ..... F24C 15/006; F24C 15/2007
USPC ..... 99/325, 327, 337, 421 PT, 423; 126/19 R, 21 R, 214, 273 R, 273 A
See application file for complete search history.

(56) References Cited

U.S. PATENT DOCUMENTS 4,331,124 A * 5/1982 Seidel et al. ..... 126/21 A
4,865,010 A * 9/1989 Kett ..... 126/21 R (Continued)

FOREIGN PATENT DOCUMENTS

EP 1909037 A2 * 4/2008 ..... F24C 15/20
JP 01110311 A * 4/1989 ..... A47J 27/00

(Continued)

OTHER PUBLICATIONS

International Search Report, PCT/JP2010/062902, Sep. 28, 2010.

*Primary Examiner* — Dana Ross
*Assistant Examiner* — Ket D Dang
(74) *Attorney, Agent, or Firm* — Birch, Stewart, Kolasch & Birch, LLP

(57) ABSTRACT

A cooking device has an exhaust duct (19) configured and arranged to mix together exhaust air discharged from an opening (61*a*) at a tip of a nozzle part (61) and part of cooling air discharged from a cooling fan and guide the mixed exhaust air to discharge it outside of a casing, and an exhaust duct temperature sensor (70) placed within the exhaust duct (19) to detect a temperature of an atmosphere inside the exhaust duct at a portion upper than the opening (61*a*) of the nozzle (61). A fan abnormal-stop detection part detects an abnormal stop of the fan when an increment per unit time of an atmosphere temperature inside the exhaust duct (19) detected by the temperature sensor (70) during cooking becomes equal to or higher than a first threshold value.

19 Claims, 13 Drawing Sheets

(56) References Cited

U.S. PATENT DOCUMENTS

| | | | | |
|---|---|---|---|---|
| 5,420,396 | A * | 5/1995 | Itoh et al. | 219/497 |
| 5,660,051 | A * | 8/1997 | Sakakibara et al. | 62/133 |
| 5,731,570 | A * | 3/1998 | Aoki | 219/497 |
| 5,918,589 | A * | 7/1999 | Valle et al. | 126/193 |
| 7,361,871 | B2 * | 4/2008 | Cho et al. | 219/689 |
| 2006/0237425 | A1 * | 10/2006 | Kim et al. | 219/400 |
| 2007/0158328 | A1 | 7/2007 | Kim et al. | |
| 2009/0050130 | A1 * | 2/2009 | Kim et al. | 126/21 A |

FOREIGN PATENT DOCUMENTS

| | | | |
|---|---|---|---|
| JP | 4-055621 | A | 2/1992 |
| JP | 2002-263006 | A | 9/2002 |
| JP | 2005-282556 | A | 10/2005 |
| JP | 2007-061515 | A | 3/2007 |
| JP | 2007-170812 | A | 7/2007 |
| JP | 2008-067804 | A | 3/2008 |

* cited by examiner

COOKING DEVICE

TECHNICAL FIELD

The present invention relates to a cooking device.

BACKGROUND ART

Conventionally, there has been a cooking device in which an electric component chamber is formed in a lateral side region of a heating chamber within a device body, with provision of a cooling fan for cooling electric components within the electric component chamber (see, e.g., JP 4-55621 A (PTL1)).

In this cooking device, a temperature difference between normal operation and abnormal operation of the cooling fan is detected by a self-heating type thermistor placed on a leeward side of the cooling fan, and an abnormal stop of the cooling fan is detected based on the temperature difference. Then, the cooking device, upon detection of an abnormal stop of the cooling fan, interrupts electrical conduction to the electric components such as a heater so as to prevent the electric components from being damaged due to temperature rises.

However, in the cooking device shown above, the self-heating type thermistor for use of detecting abnormal stops of the cooling fan has such problems as high parts cost and excess consumption of electric power for self heating.

CITATION LIST

Patent Literature

PTL1: JP 4-55621 A

SUMMARY OF INVENTION

Technical Problem

Accordingly, an object of the invention is to provide a cooking device capable of detecting an abnormal stop of the fan with a simple construction without using a self-heating type thermistor.

Solution to Problem

A cooking device according to the present invention includes:

a casing;

a heating chamber placed in the casing;

a fan placed in the casing;

an exhaust path having one end connected to the heating chamber;

an exhaust duct configured and arranged to mix together exhaust air discharged from another end of the exhaust path and at least part of air from the fan and guide the mixed exhaust air to outside of the casing such that the mixed exhaust air is discharged outside;

a temperature sensor configured and arranged to detect a temperature of an atmosphere inside the exhaust duct; and a fan abnormal-stop detection part configured and arranged to detect an abnormal stop of the fan when an increment per unit time of an atmosphere temperature inside the exhaust duct detected by the temperature sensor during cooking becomes equal to or higher than a first threshold value or when an atmosphere temperature inside the exhaust duct detected by the temperature sensor during cooking becomes equal to or higher than a fan abnormal-stop decision temperature.

The fan may be an exhaust fan for feeding air to the exhaust duct or a cooling fan for cooling at least part of electric components placed in the casing, the fan having only to be one related to exhaust.

With this constitution, the exhaust duct mixes together exhaust air from within the heating chamber and at least part of air from the fan and guides the mixed exhaust air to outside of the casing to discharge the air outside. In this case, if the fan is in normal operation, the atmosphere temperature inside the exhaust duct detected by the temperature sensor is generally equal to the temperature of the air from the fan, and far lower than the temperature of the exhaust air from within the heating chamber. However, upon an abnormal stop of the fan due to a fault or the like, the air from the fan is no longer fed to the exhaust duct, so that the air stream within the exhaust duct stagnates while the exhaust air from within the heating chamber continues to gradually flow into the exhaust duct via the exhaust path. Therefore, the temperature sensor detects an increase of the atmosphere temperature inside the exhaust duct. By making use of this temperature increase due to an abnormal stop of the fan, the fan abnormal-stop detection part detects an abnormal stop of the fan when the increment per unit time of the atmosphere temperature inside the exhaust duct detected by the temperature sensor during cooking becomes equal to or higher than the first threshold value. Otherwise, the fan abnormal-stop detection part detects an abnormal stop of the fan when the atmosphere temperature inside the exhaust duct detected by the temperature sensor during cooking becomes equal to or higher than the fan abnormal-stop decision temperature. Thus, an abnormal stop of the fan can be detected without use of a self-heating type thermistor and with a simple construction of the device.

In one embodiment, the temperature sensor is configured and arranged to detect an atmosphere temperature inside the exhaust duct at a portion upper than an inlet opening through which the exhaust air from the exhaust path flows into the exhaust duct.

According to this embodiment, by wind pressure of the air from the fan, the exhaust duct mixes together exhaust air from the exhaust path and at least part of air from the fan and guides the resulting mixed air to outside of the casing to discharge the air outside. In this case, if the fan is in normal operation, the atmosphere temperature inside the exhaust duct detected by the temperature sensor is generally equal to the temperature of the air from the fan, and far lower than the temperature of the exhaust air from within the heating chamber. However, upon an abnormal stop of the fan due to a fault or the like, the air from the fan no longer flows into the exhaust duct, so that the air stream within the exhaust duct stagnates while the exhaust air from within the heating chamber continues to flow into the exhaust duct via the exhaust path, with the result that the high-temperature exhaust air from the exhaust path goes upper than the inlet opening within the exhaust duct. Therefore, the temperature sensor placed in the exhaust duct promptly detects an increase of the atmosphere temperature of part of inside of the exhaust duct upper than the inlet opening through which the exhaust air from the exhaust path flows into the exhaust duct. In such an abnormal stop of the fan, the atmosphere temperature inside the exhaust duct detected by the temperature sensor changes to a large extent, making it possible for the fan abnormal-stop detection part to securely and promptly detect an abnormal stop of the fan.

Thus, an exhaust-related abnormal stop of the fan can be detected promptly without use of a self-heating type thermistor and with a simple construction of the device.

In a case where the fan serves also for cooling of electric components, promptly detecting an abnormal stop of the fan makes it possible to prevent electric components such as the heater from being damaged due to temperature rises by stopping energization of the electric components. Also, by stopping the operation before deposition of steam or generation of condensations on the electric components, damage to the electric components or the like can be prevented in advance.

In one embodiment, the exhaust duct has a blow-in opening, on an upstream side thereof, through which at least part of air from the fan blows into the exhaust duct, and a discharge opening, on a downstream side thereof, through which the mixed exhaust air is discharged outside, with the inlet opening for flow-in of the exhaust air from the exhaust path being placed in an air path between the blow-in opening and the discharge opening, and the temperature sensor is placed upstream of the inlet opening for flow-in of the exhaust air from the exhaust path in the exhaust duct.

According to this embodiment, the inlet opening for flow-in of exhaust air from the exhaust path is placed in the air path between the upstream-side blow-in opening and the downstream-side discharge opening of the exhaust duct, and the temperature sensor is placed in the exhaust duct on the upstream side of the inlet opening for flow-in of exhaust air from the exhaust path. By this arrangement, the temperature of air that flows in from the fan is detected by the temperature sensor during normal operation of the fan. In an abnormal stop of the fan, on the other hand, high-temperature exhaust air that has flowed in from the exhaust path moves toward the upstream side of the inlet opening within the exhaust duct so that high-temperature exhaust air is detected by the temperature sensor. Therefore, the atmosphere temperature inside the exhaust duct detected by the temperature sensor changes to a large extent between normal operation and abnormal stop of the fan, making it possible to more securely detect an abnormal stop of the fan.

In one embodiment, inner surfaces of the exhaust duct include an upper-side surface and a lower-side surface lower than the upper-side surface, and the upper-side surface of the exhaust duct is inclined so as to gradually lower from the upstream side toward the downstream side.

In this case, the exhaust duct may be formed into a quadrilateral or other polygonal shape in cross section, or a circular or elliptical shape in cross section, or other cross-sectional shape. With a quadrilateral or other polygonal cross-sectional shape, at least an uppermost surface out of inner surfaces of the exhaust duct forms the upper-side surface. With a circular or elliptical cross-sectional shape, at least an uppermost region out of the inner surface of the exhaust duct forms the upper-side surface.

According to this embodiment, by the arrangement that the upper-side surface of the exhaust duct is inclined so as to gradually lower in height from upstream side toward downstream side, high-temperature exhaust air that has flowed into the exhaust duct from the exhaust path easily moves toward the upstream side along the upper-side surface within the exhaust duct during an abnormal stop of the fan. Thus, the high-temperature exhaust air that has moved can be detected promptly by the temperature sensor.

In one embodiment, the first threshold value comprises a plurality of first threshold values which are set for at least two temperature regions such that a first threshold value for a higher temperature region is smaller than a first threshold value for a lower temperature region.

According to this embodiment, with use of the first threshold values which are set for at least two temperature regions, respectively, such that a first threshold value for a higher temperature region is smaller than a first threshold value for a lower temperature region, the fan abnormal-stop detection part determines an increment per unit time of the atmosphere temperature inside the exhaust duct detected by the temperature sensor during cooking. Thus, the fan abnormal-stop detection part makes a decision by using the larger first threshold value for the low temperature region that shows larger changes in temperature rise at an abnormal stop of the fan, while the detection part makes a decision by using the smaller first threshold value for the high temperature region that shows smaller changes in temperature rise at an abnormal stop of the fan. Therefore, an accurate decision for a wider temperature region is achievable.

In an embodiment, when a starting-point temperature and a terminating-point temperature, from which the increment per unit time of the atmosphere temperature inside the exhaust duct detected by the temperature sensor is determined, belong to different temperature regions, the fan abnormal-stop detection part uses a smallest one of the first threshold values set for these temperature regions to detect an abnormal stop of the fan.

According to this embodiment, when a starting-point temperature and a terminating-point temperature, from which the increment per unit time of the atmosphere temperature inside the exhaust duct detected by the temperature sensor is determined, belong to different temperature regions, the fan abnormal-stop detection part uses the smallest one of the first threshold values set for these temperature regions to detect an abnormal stop of the fan. Therefore, since the fan abnormal-stop detection part makes a decision by using a first threshold value set for a temperature region showing smaller changes of temperature rise at an abnormal stop of the fan, there can be achieved an accurate decision.

In one embodiment, the fan abnormal-stop detection part is inhibited from detecting an abnormal stop of the fan until after a first specified time has passed after a start of cooking.

According to this embodiment, since the fan abnormal-stop detection part is inhibited from detecting an abnormal stop of the fan until after the first specified time has elapsed after the start of cooking, misdetections of an abnormal stop of the fan can be prevented even if the ambient environmental temperature has abruptly changed immediately before an operation start of cooking (e.g., in a case where cooking is performed with the cooking device moved from a cold place to a room-temperature environment).

In one embodiment, the cooking device further includes a cooking control part that works such that when an abnormal stop of the fan is detected by the fan abnormal-stop detection part, if the atmosphere temperature inside the exhaust duct detected by the temperature sensor is not more than a cooking-operation-resumption decision temperature, the cooking control part resumes a cooking operation.

According to this embodiment, upon detection of an abnormal stop of the fan by the fan abnormal-stop detection part, if the atmosphere temperature inside the exhaust duct detected by the temperature sensor is not more than a cooking-operation-resumption decision temperature, the cooking control part resumes the cooking operation. Therefore, it is implementable to complete the cooking to the end.

In one embodiment, the cooking device further includes a fan control part that controls the fan based on an atmosphere temperature inside the exhaust duct detected by the temperature sensor.

According to this embodiment, the fan is controlled by the fan control part based on an atmosphere temperature inside the exhaust duct detected by the temperature sensor. As a result, by inhibiting the fan from rotating until after the interior temperature of the heating chamber increases enough at a start of cooking for example, it becomes implementable to achieve an energy saving or securely suppress temperature decreases in the heating chamber due to operation of the fan upon a start of cooking.

In one embodiment, the fan control part starts operation of the fan when an increment per unit time of the atmosphere temperature inside the exhaust duct detected by the temperature sensor after a start of cooking becomes equal to or higher than a second threshold value, or when the atmosphere temperature inside the exhaust duct detected by the temperature sensor after a start of cooking becomes equal to or higher than a fan-operation start decision temperature.

According to this embodiment, even if no air from the fan is fed to the exhaust duct at a start of cooking, exhaust air from within the heating chamber flows into the exhaust duct gradually as the chamber-interior temperature rises. As a result of this, the temperature sensor placed in the exhaust duct detects an increase of the atmosphere temperature inside the exhaust duct. Then, the fan control part starts operation of the fan when an increment per unit time of the atmosphere temperature inside the exhaust duct detected by the temperature sensor becomes equal to or higher than the second threshold value after the start of cooking. Otherwise, the fan control part starts operation of the fan when the atmosphere temperature inside the exhaust duct detected by the temperature sensor after the start of cooking becomes equal to or higher than the fan-operation start decision temperature. Thus, since the fan is inhibited from rotating until the chamber-interior temperature increases enough upon a start of cooking, it becomes implementable to achieve an energy saving and moreover securely suppress temperature decreases inside the heating chamber due to the operation of the fan at the time of cooking start. For next cooking to be performed continuously subsequent to an end of cooking, since the interior temperature of the heating chamber has already become high, the fan may be immediately started to be operated.

In one embodiment, upon detection of an abnormal stop of the fan by the fan abnormal-stop detection part during operation of the fan, the fan is stopped by the fan control part, and when an increment in a period of a second specified time of the atmosphere temperature inside the exhaust duct detected by the temperature sensor after the stop of the fan is equal to or higher than a third threshold value, the fan abnormal-stop detection part decides that the stop of the fan is no abnormal stop and the fan control part resumes the operation of the fan.

According to this embodiment, when the fan abnormal-stop detection part detects an abnormal stop of the fan during operation of the fan in the cooking operation, the fan is stopped by the fan control part. Then, when the increment in the period of the second specified time of the atmosphere temperature inside the exhaust duct detected by the temperature sensor after the stop of the fan is not less than the third threshold value, the fan abnormal-stop detection part decides that the stop of the fan is no abnormal stop, and the operation of the fan is resumed by the fan control part. Even if the fan abnormal-stop detection part detects an abnormal stop of the fan, there are some cases where the fan is really not abnormally stopped but was normally working. In such a case, stopping the normally-operating fan by the fan control part would cause the atmosphere temperature inside the exhaust duct to be increased, where this temperature increase makes it found that the fan is not in an abnormal stop. Therefore, even if an abnormal stop of the fan is mis-detected, the fan can be continuously operated to perform the cooking.

In one embodiment, upon detection of an abnormal stop of the fan by the fan abnormal-stop detection part during operation of the fan, the fan is stopped by the fan control part, and when an increment in a period of a second specified time of the atmosphere temperature inside the exhaust duct detected by the temperature sensor after the stop of the fan is less than a third threshold value, the fan abnormal-stop detection part decides that the stop of the fan is an abnormal stop.

According to this embodiment, upon detection of an abnormal stop of the fan by the fan abnormal-stop detection part during operation of the fan in the cooking operation, the fan is stopped by the fan control part, and when an increment in the period of the second specified time of the atmosphere temperature inside the exhaust duct detected by the temperature sensor after the stop of the fan is less than the third threshold value, the fan abnormal-stop detection part decides that the stop of the fan is an abnormal stop. In case of an abnormal stop of the fan, the atmosphere temperature inside the exhaust duct does not increase much, showing little change. Thus, with confirmation that there is no such temperature increase, an abnormal stop of the fan can securely be detected.

In one embodiment, the cooking device further includes a door for opening and closing an opening of the heating chamber, and a door opening/closing sensor for detecting an opened/closed state of the door. And, based on an opened/closed state of the door detected by the door opening/closing sensor, the fan abnormal-stop detection part is inhibited from detecting an abnormal stop of the fan until after a third specified time has elapsed after there was a change from an opened to a closed state of the door.

According to this embodiment, based on the opened/closed state of the door detected by the door opening/closing sensor, the fan abnormal-stop detection part is inhibited from detecting an abnormal stop of the fan for the third specified time after the door was changed from an opened to a closed state. Thus, in opening/closing of the door during cooking, even if high-temperature exhaust air led from within the heating chamber to the exhaust duct at a closing of the door causes the atmosphere temperature inside the exhaust duct to be increased, misdetections of an abnormal stop of the fan by the fan abnormal-stop detection part can securely be prevented.

Advantageous Effects of Invention

As is apparent from the above, the present invention realizes a cooking device that detects an abnormal stop of the fan without use of a self-heating type thermistor and with a simple construction of the device.

DESCRIPTION OF EMBODIMENTS

Figure 1:
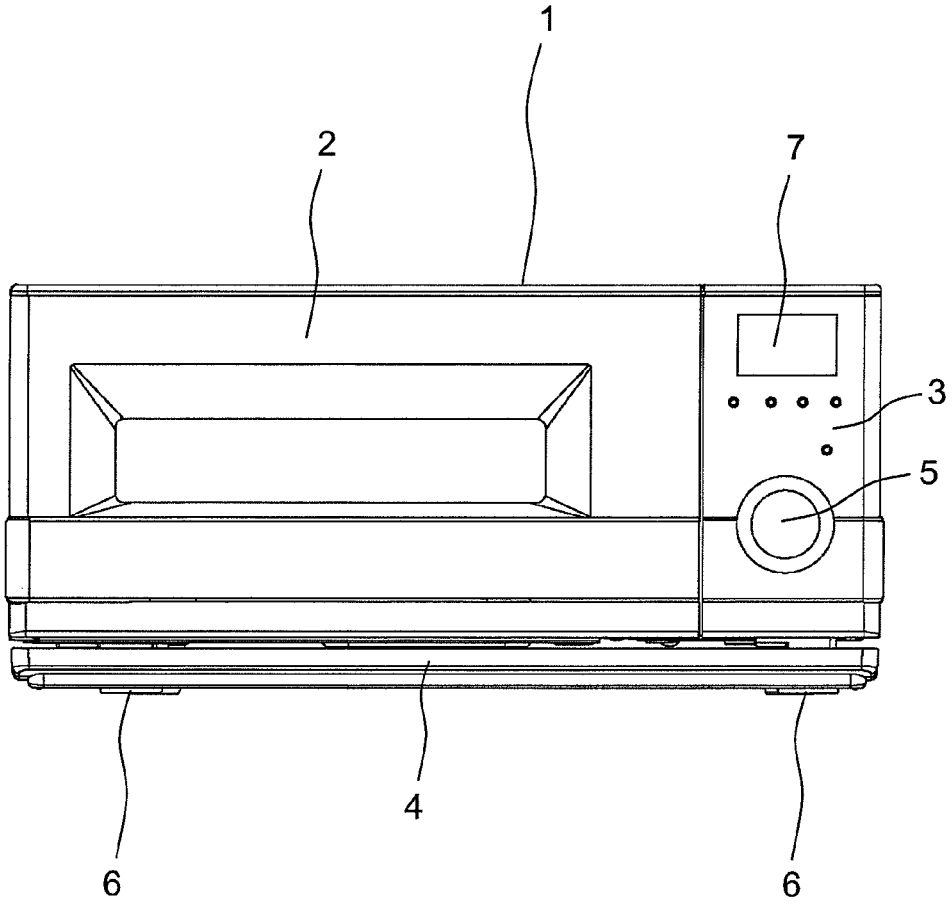
FIG. 1 is a front view of a cooking device in accordance with an embodiment of the invention.

Hereinbelow, a cooking device of the invention will be described in detail with reference to embodiments shown in the drawings.

FIG. 1 is a front view of a cooking device in accordance with an embodiment of the invention.

The cooking device has a casing 1, and a door 2 with handle (simply "door 2" below) that is mounted on a front face side of the casing 1. An operation panel 3 is provided on the front face side of the casing 1 so as to adjoin the door 2 with handle that is closed. A dew receiving container 4 is provided under the door 2 and the operation panel 3.

A generally cylindrical dial 5 is rotatably mounted on the operation panel 3. The operation panel 3 has a liquid crystal display part 7, which provides displays according to operations of the dial 5.

The dew receiving container 4 is a container that is attachable to and detachable from two front legs 6, 6 that are provided on the front side of bottom part of the casing 1. Once the dew receiving container 4 is inserted to an underside of the casing 1 from the front side toward the rear side and is mounted on the front legs 6, 6, a portion of the dew receiving container 4 is positioned under a rear face (back face) of the door 2 that is closed. Thus condensate water deposited on the rear face of the door 2 drops into the dew receiving container 4 placed under an opening 8*a* (shown in FIG. 2B) of a heating chamber 8 (shown in FIG. 2B) when the door 2 is opened.

Figure 2A:
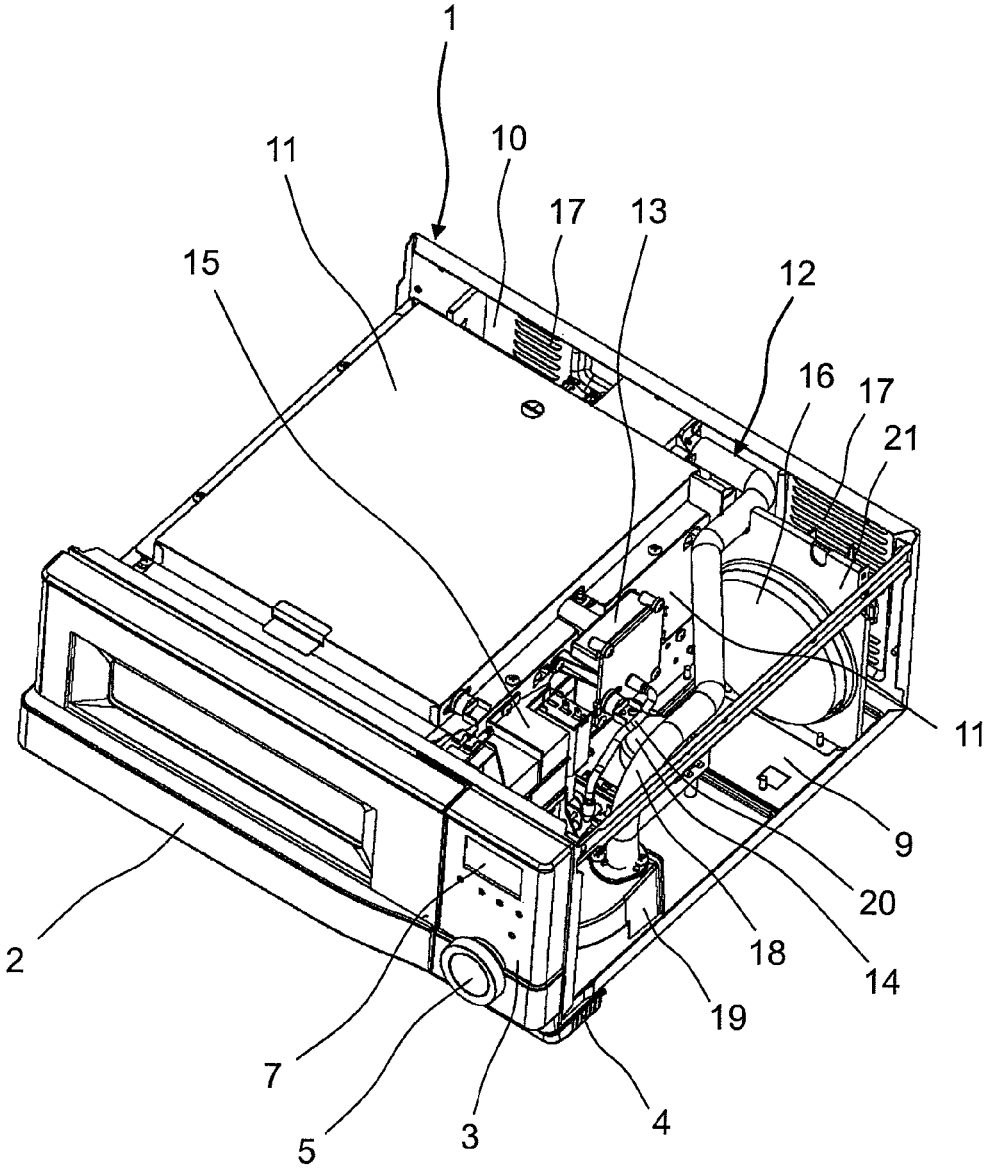
FIG. 2A is a perspective view of the cooking device, from which a top part and both lateral side parts of a casing are removed, as seen looking from a front and diagonal upper side thereof.
Figure 2B:
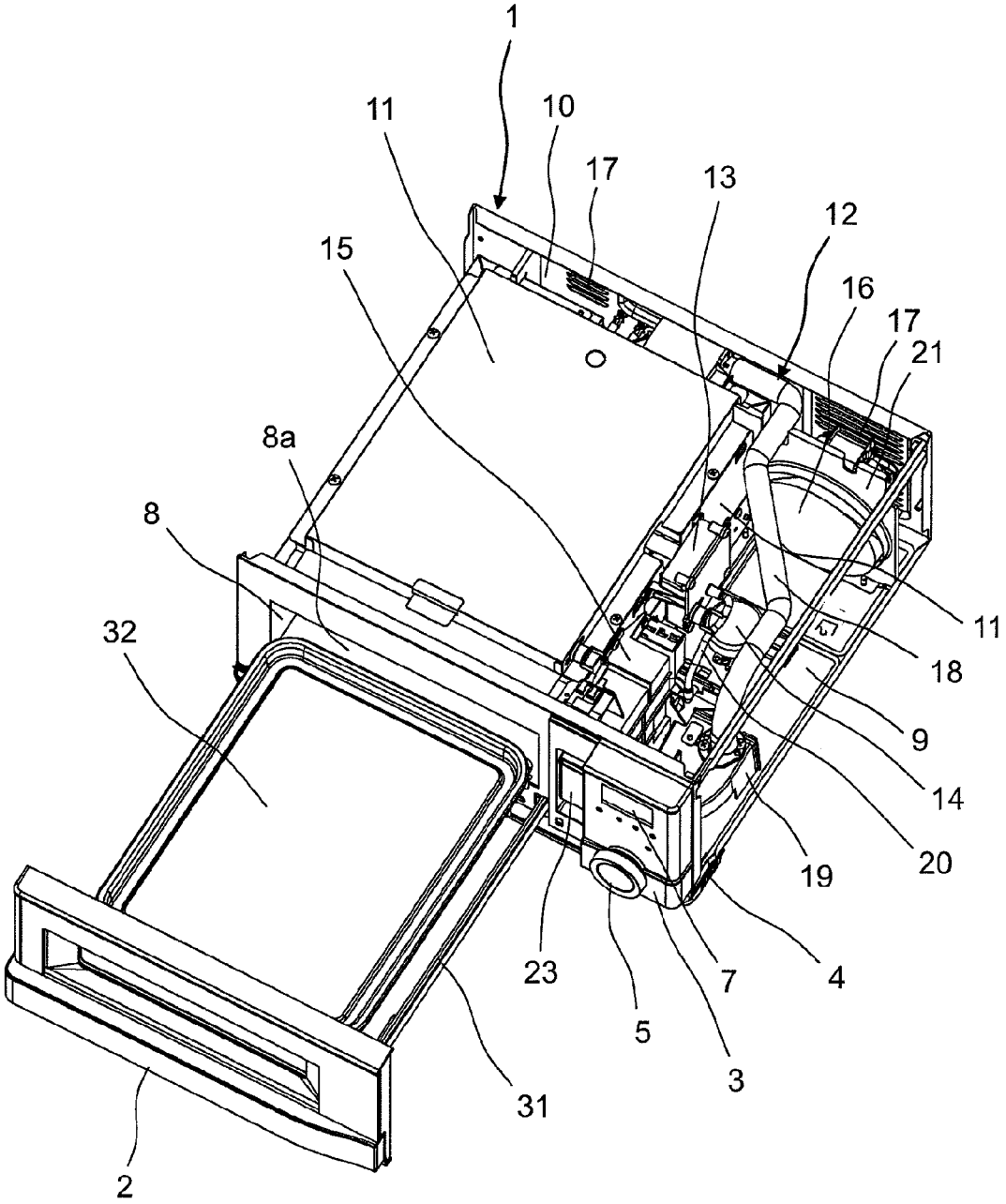
FIG. 2B is a perspective view of the cooking device with a door with handle opened.
Figure 3:
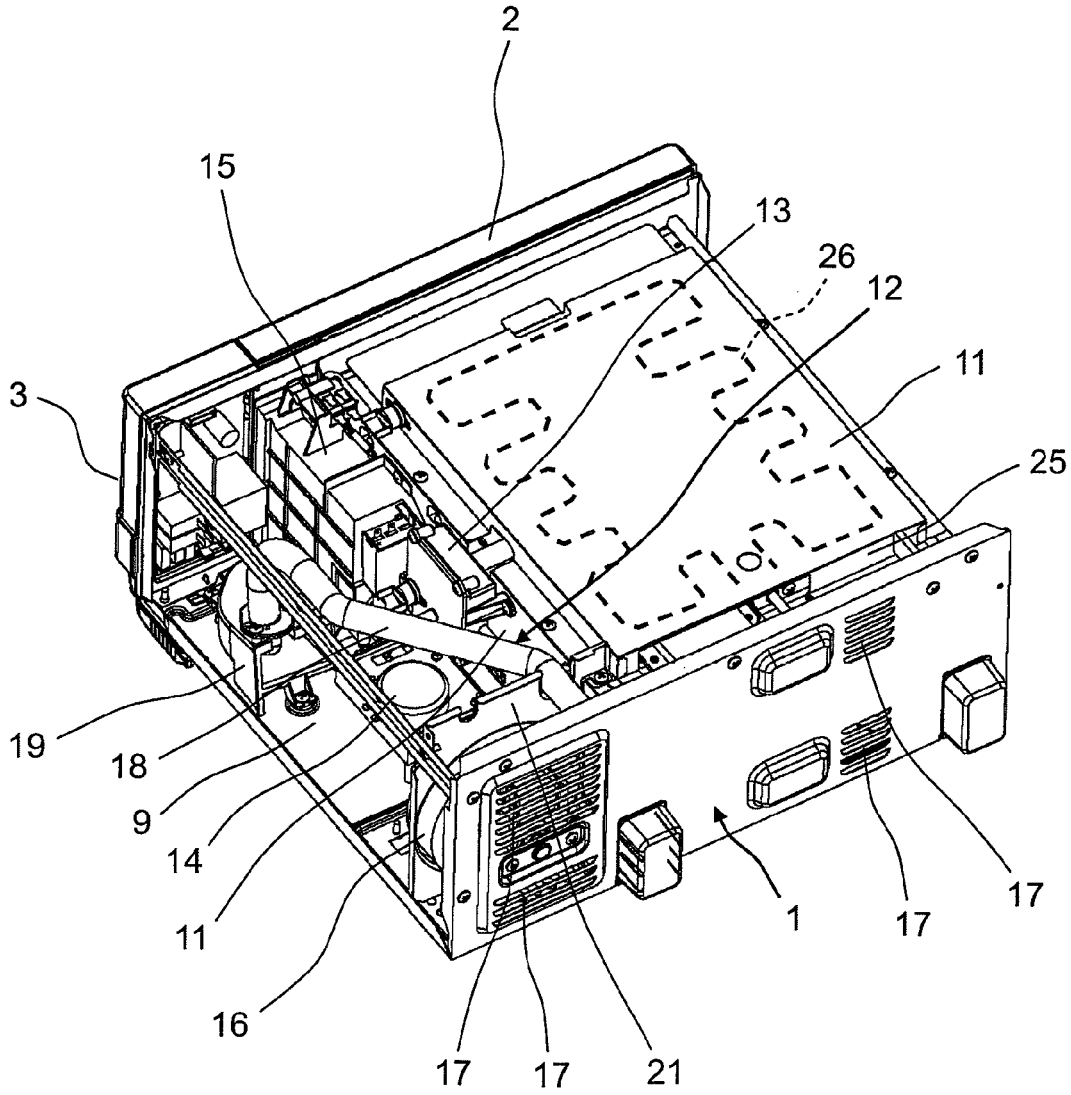
FIG. 3 is a perspective view of the cooking device as seen looking from a rear and diagonal upper side thereof.

FIG. 2A shows a perspective view of the cooking device, from which a top part and both side parts of the casing 1 are removed, as seen looking from a front and diagonal upper side, and FIG. 2B shows a perspective view of the cooking device with the door 2 opened. FIG. 3 is a perspective view of the cooking device of FIG. 2A as seen looking from a rear and diagonal upper side. In FIGS. 2A, 2B and 3, the same components are provided with the same reference numerals.

As shown in FIGS. 2A, 2B and 3, the heating chamber 8 for heating an object to be cooked is provided in the casing 1 (see FIG. 2B). In the casing 1, an electric component chamber 9 as an example of a cooling space is provided on a lateral side of the heating chamber 8 and on rear side of the operation panel 3, and an air intake space 10 is provided on a rear side of the heating chamber 8 and on a rear side of the electric component chamber 9.

The heating chamber 8 has the opening 8*a* (shown in FIG. 2B) on the front face side, and the door 2 opens and closes the opening 8*a* by being slid forward and rearward by a pair of rail units 31. The rail units 31 each have a movable rail that has one end fixed to the door 2 and a fixed rail that is fixed to the casing 1 and that slidably supports the movable rail. A tray 32 is drawn out with the door 2. By opening and closing of the door 2, an object to be cooked that is placed on the tray 32 is taken out of and put into the heating chamber 8. Heat shield plates 11, 11, . . . are provided on top, bottom, rear side, and both lateral sides of the heating chamber 8. That is, the heat shield plates 11, 11, . . . are provided around the heating chamber 8 except on the opening 8*a*. Spaces between the heat shield plates 11 and the heating chamber 8 are filled with heat insulating material (not shown).

In the electric component chamber 9 are a steam producing device 13 for producing steam that is supplied into the heating chamber 8, a water supply pump 14 connected to the steam producing device 13 through a water supply tube 20, and a tank housing part 15 placed in front of the water supply pump 14. When the object to be cooked is heated, cooling air from a cooling fan 16 flows through the electric component chamber 9 so that electric components such as the water supply pump 14 can be cooled.

With drive of the cooling fan 16, air outside the casing 1 flows through four air intakes 17, 17, 17, 17 into the air intake space 10. The air in the air intake space 10 is delivered into the electric component chamber 9 by the cooling fan 16. The air intakes 17 are each composed of a plurality of slits provided on a rear part of the casing 1.

An upstream end of the exhaust tube 18 as an example of an exhaust path is connected to an exhaust opening, provided on the rear part of the heating chamber 8, through a catalyst unit (not shown) provided above the rear part of the heating chamber 8. A downstream end (exhaust exit) of the exhaust tube 18 is connected to an exhaust duct 19 that is provided on a lateral side of the tank housing part 15 and that is made of synthetic resin. The exhaust tube 18 is composed of synthetic resin having flexibility and is provided so as to extend from an upper part of the rear face side to a lower part of the front face side of the electric component chamber 9.

Gas in the heating chamber 8 is discharged out of the casing 1 by being guided from the rear part to the front face side of the casing 1 by the exhaust tube 18 and the exhaust duct 19.

In FIGS. 2A, 2B and 3, reference numeral 21 denotes a partition wall that serves as a partition between the electric component chamber 9 and the air intake space 10. The cooling fan 16 is mounted on the partition wall 21. As shown in FIG. 3, an upper heater housing part 25 is provided on upper side in the heating chamber 8, and an upper heater 26 is provided in the upper heater housing part 25. A steam temperature increasing device is composed of the upper heater housing part 25 and the upper heater 26. A lower heater housing part (not shown) is provided on lower side in the heating chamber 8, and a lower heater (not shown) is provided in the lower heater housing part.

Figure 4:
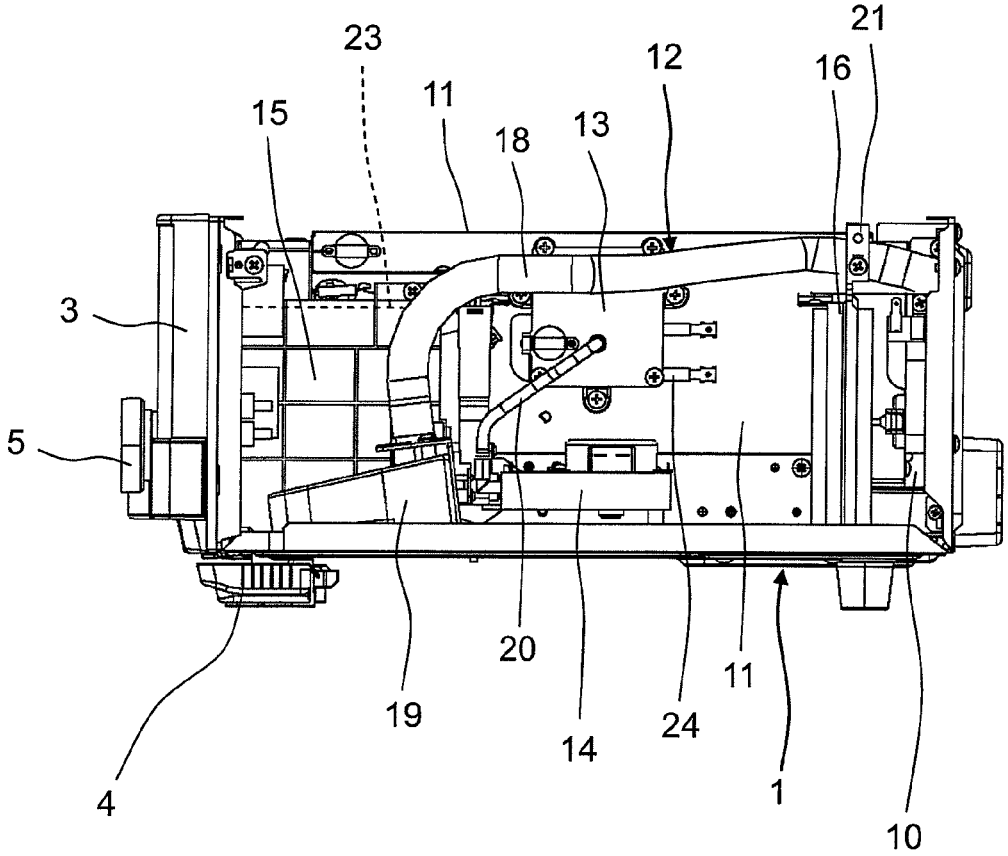
FIG. 4 is a perspective view of the cooking device as seen looking from a lateral side thereof.

FIG. 4 is a perspective view of the cooking device of FIG. 2A as seen looking from a lateral side thereof.

The tank housing part 15 houses a water supply tank 23. Once the door 2 is opened, a front face of the water supply tank 23 is exposed so that the water supply tank 23 can be drawn out of and inserted into the tank housing part 15 (see FIG. 2B). Water in the water supply tank 23 is supplied through the water supply tube 20 into the steam producing device 13 by drive of the water supply pump 14. The steam producing device 13 heats the water from the water supply pump 14 by a steam producing heater 24 and thereby produces steam.

Figure 5:
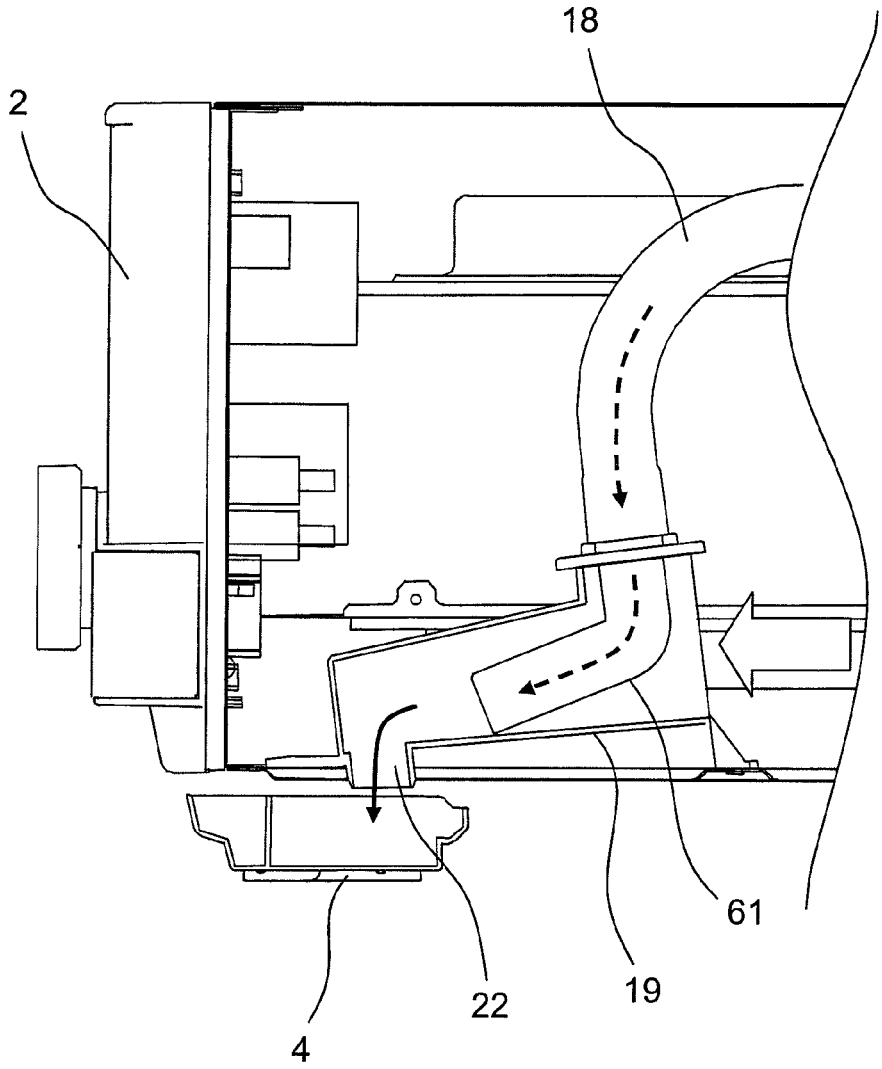
FIG. 5 is a schematic representation of an enlarged section of an important part of the cooking device, as seen looking from the lateral side thereof.

FIG. 5 shows a schematic representation of an enlarged section of an important part of the cooking device, as seen looking from the lateral side thereof. As shown in FIG. 5, a discharge port 22 is provided on front bottom part of the exhaust duct 19. The discharge port 22 extends through the bottom part of the casing 1 and faces the dew receiving container 4. A nozzle part 61 to which the downstream end of the exhaust tube 18 is connected is received in the exhaust duct 19, and an opening 61*a* (an inlet into which exhaust gas enters from an exhaust path) is at an extremity of the nozzle part 61 is directed toward the discharge port 22. The exhaust tube 18 and the nozzle part 61 form the exhaust path. The exhaust path and the exhaust duct 19 form an exhaust guide.

Figure 6A:
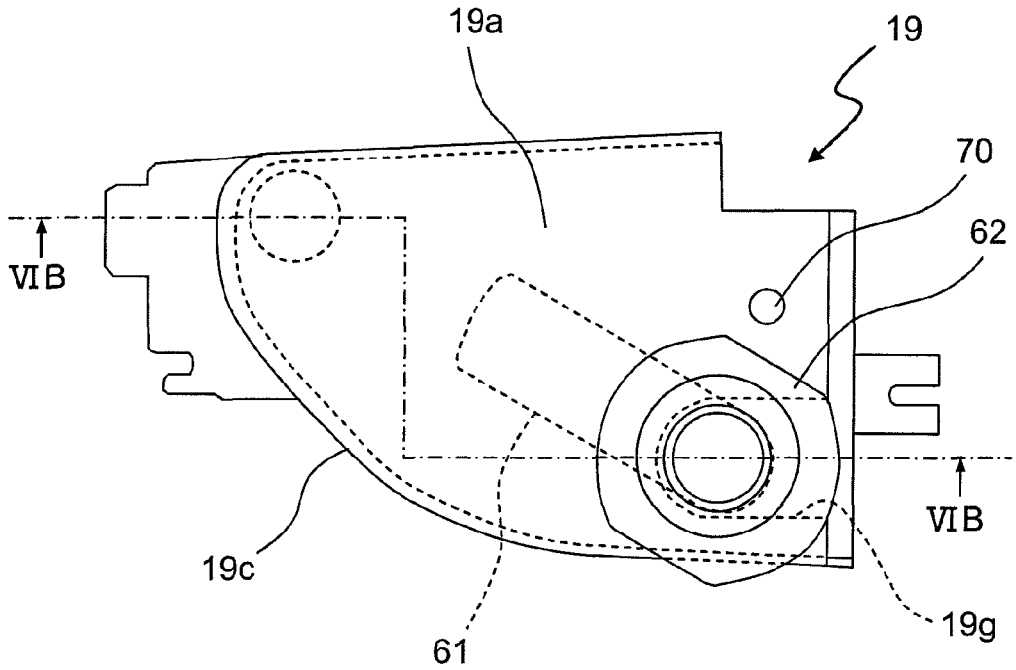
FIG. 6A is a top plan view of an exhaust duct.
Figure 6B:
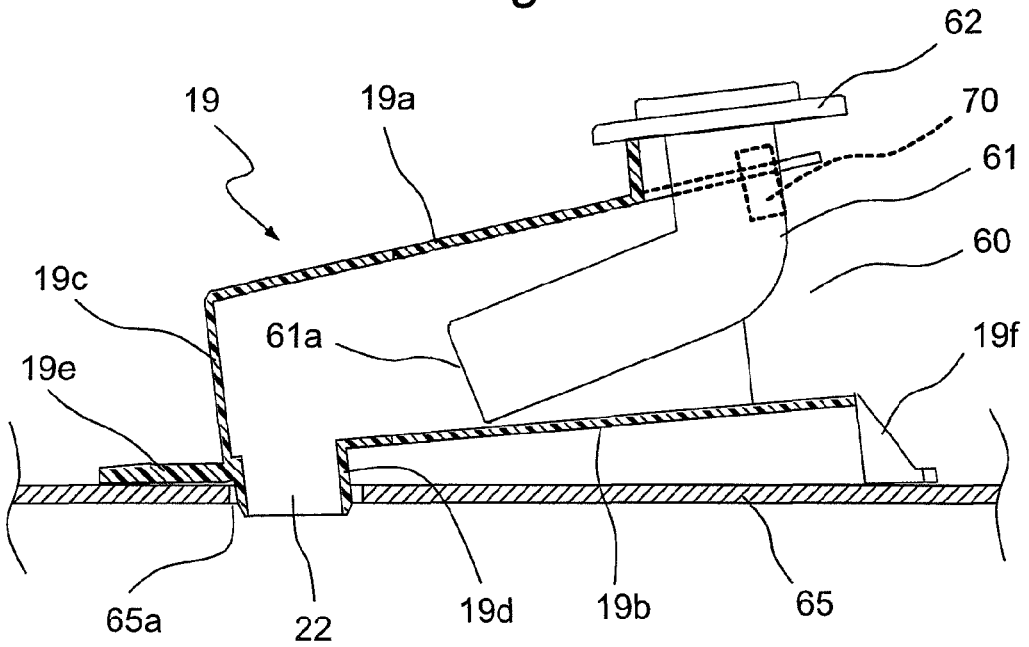
FIG. 6B is a sectional view taken along a line VIB-VIB of FIG. 6A.

FIG. 6A shows a top face of the exhaust duct 19, and FIG. 6B shows a sectional view of the exhaust duct 19 taken along a line VIB-VIB of FIG. 6A.

As shown in FIGS. 6A and 6B, the exhaust duct 19 is shaped so as to taper from a blow-in opening 60 toward the discharge port 22 and has a top wall 19*a*, a bottom wall 19*b*, a side wall 19*c* that is provided so as to enclose a space between an outer edge of the top wall 19*a* and an outer edge of the bottom wall 19*b* except the blow-in opening 60, a tubular part 19*d* that defines the discharge port 22, a first fixed part 19*e* that is provided so as to protrude frontward from vicinity of the tubular part 19*d*, and a second fixed part 19*f* that is provided in vicinity of a lower edge of the blow-in opening 60 of the bottom wall 19*b*. In the exhaust duct 19, a cutout 19*g* is formed at the top wall 19*a* defining an upper edge of the blow-in opening 60.

The nozzle part 61 generally shaped like a letter L is fitted into the cutout 19*g* of the exhaust duct 19, from a side of the blow-in opening 60. The nozzle part 61 is fixed to the top wall 19*a* of the exhaust duct 19 with use of a mounting flange 62 fixed to an upper end of the nozzle part 61. The downstream end of the exhaust tube 18 is connected to the upper end of the nozzle part 61.

The tubular part 19*d* of the exhaust duct 19 is inserted into a hole 65*a* provided on a bottom plate 65, and the exhaust duct 19 is fixed to the bottom plate 65 by screws (not shown) with use of the first fixed part 19*e* and the second fixed part 19*f*. In this state, an upper surface of the bottom wall 19*b* of the exhaust duct 19 is inclined with respect to a plane of the bottom plate 65 so that a front side thereof is lowered. In this embodiment, an angle between the upper surface of the bottom wall 19*b* of the exhaust duct 19 and the plane of the bottom plate 65 is set between 2 and 3 degrees. Thus water in the exhaust duct 19 flows toward the discharge port 22 and falls therefrom without flowing out from the blow-in opening 60.

The exhaust duct 19 is shaped so as to taper off from the blow-in opening 60 on an upstream side thereof toward the discharge port 22 on a downstream side thereof. The tapered shape smoothes air flow in the exhaust duct 19 and causes exhaust from the opening 61*a* on the extremity of the nozzle part 61 to be drawn and guided toward the discharge port 22.

Figure 7:
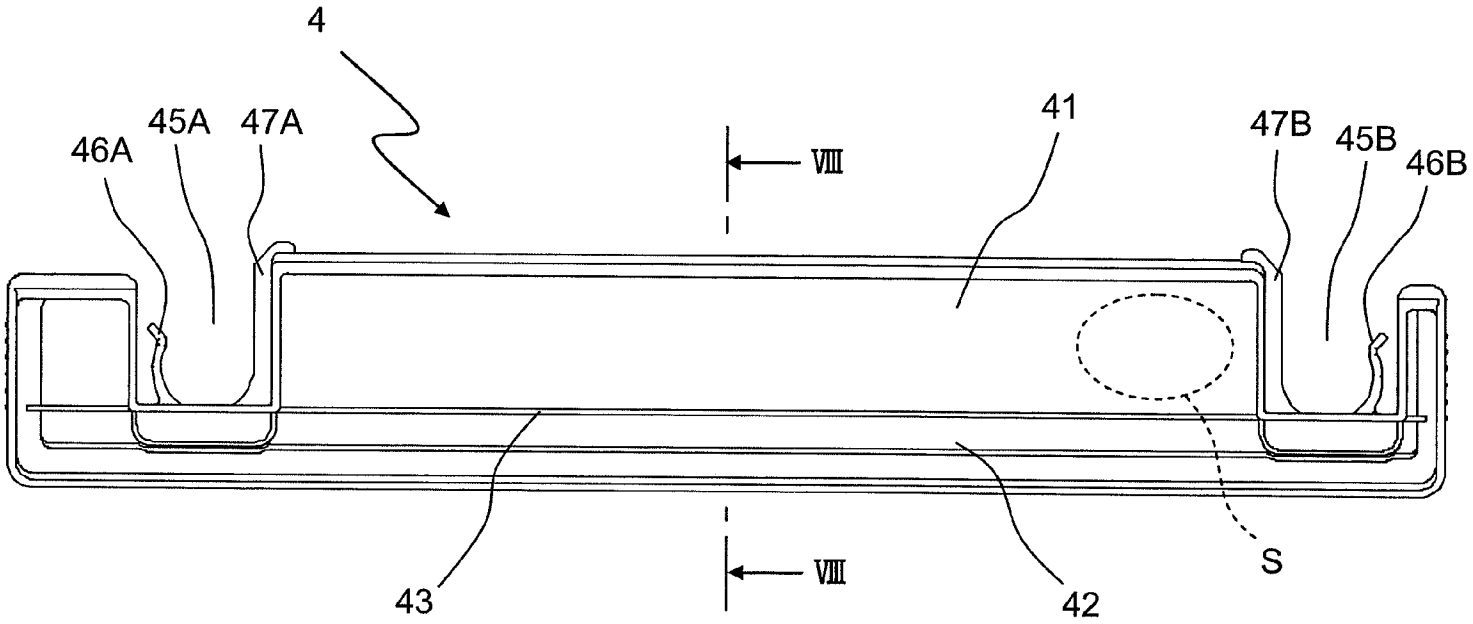
FIG. 7 is a plan view of a dew receiving container.
Figure 8:
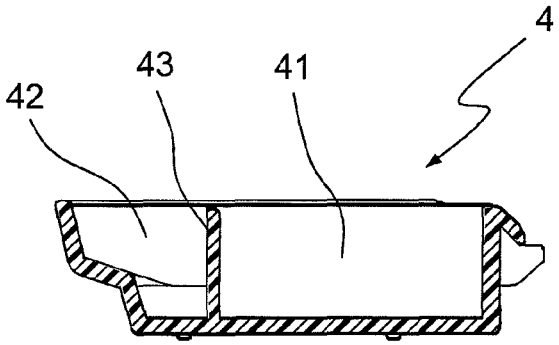
FIG. 8 is a sectional view taken along a line VIII-VIII of FIG. 7.

FIG. 7 shows a plan view of the dew receiving container 4, and FIG. 8 shows a sectional view taken along a line VIII-VIII of FIG. 7. As shown in FIGS. 7 and 8, the dew receiving container 4 has a first dew receiving recess 41 in shape of a laterally long rectangle and a second dew receiving recess 42 provided in front of the first dew receiving recess 41 with a rib 43 therebetween. Fitting recesses 45A, 45B that open on rear face side (upper side in FIG. 7) thereof are provided at opposite ends of the first dew receiving recess 41, and curved arm parts 46A, 46B that extend toward the rear face side are provided in the fitting recesses 45A, 45B, respectively. Guide parts 47A, 47B are provided on sides facing the first dew receiving recess 41 in the fitting recesses 45A, 45B, respectively.

When the dew receiving container 4 is attached to the two front legs 6, 6 (shown in FIG. 1) provided on the front side on the bottom part of the casing 1, fitting protruding parts (not shown) of the front legs 6, 6 are fitted into the fitting recesses 45A, 45B while being guided by the guide parts 47A, 47B of the dew receiving container 4. Then the curved arm parts 46A, 46B of the dew receiving container 4 undergo elastic deformation and thereby cooperate with the guide parts 47A, 47B to nip the fitting protruding parts (not shown) of the front legs 6, 6, so that the dew receiving container 4 is held by the front legs 6, 6.

A region S on right side on a bottom surface of the first dew receiving recess 41 in the dew receiving container 4 faces an opening of the discharge port 22 of the exhaust duct 19 that resides thereover. Exhaust from the discharge port 22 of the exhaust duct 19 is received by the region S in the first dew receiving recess 41 in the dew receiving container 4 that resides thereunder and is diffused to outside of the casing 1. Then the exhaust diffuses from inside of the first dew receiving recess 41 in the dew receiving container 4 through a gap between the dew receiving container 4 and the door 2, a gap between the dew receiving container 4 and the casing 1 and/or the like into a vast outside space on the front face side of the casing 1.

Waterdrops dropping from the discharge port 22 of the exhaust duct 19 are received by the first dew receiving recess 41 in the dew receiving container 4, and waterdrops dropping along the rear face of the door 2 and the front face of the casing 1 are received by the first dew receiving recess 41 and the second dew receiving recess 42 in the dew receiving container 4.

Figure 11:
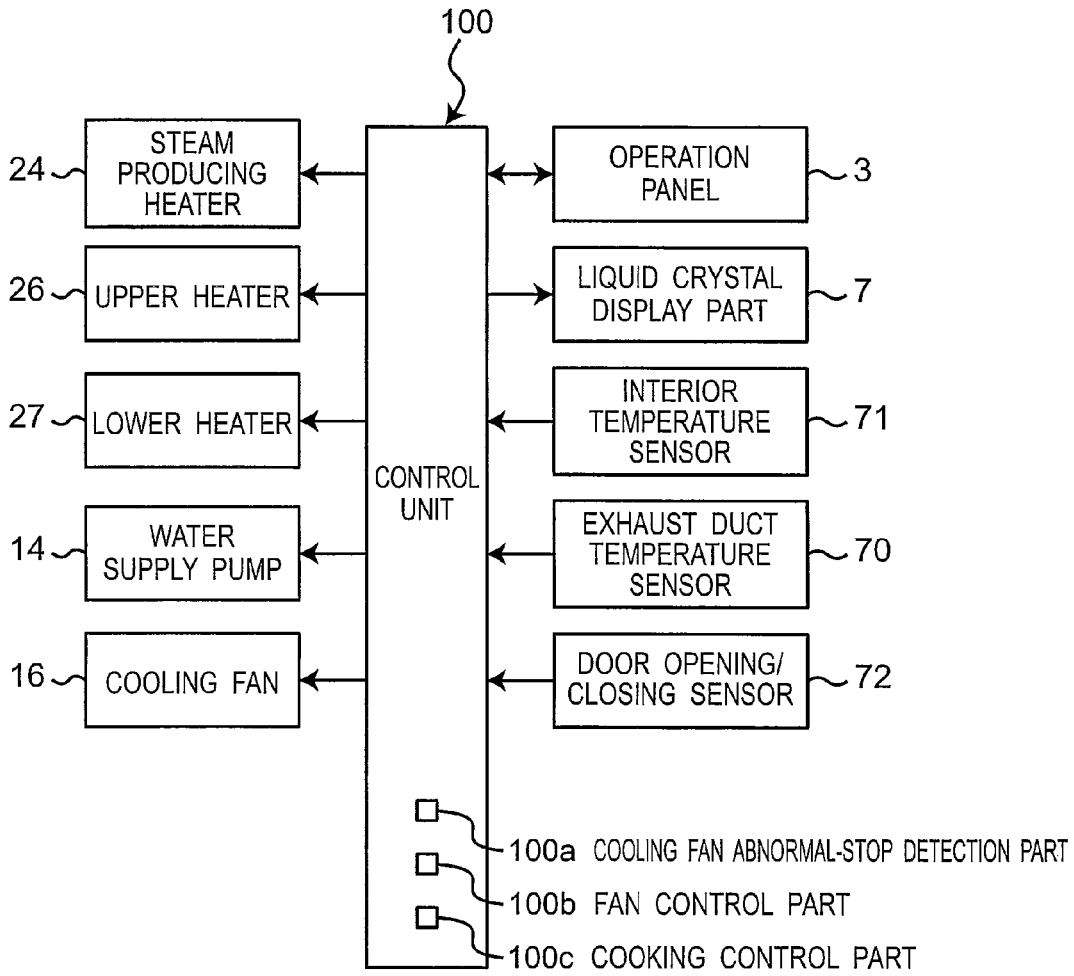
FIG. 11 is a control block diagram of the cooking device.

FIG. 11 is a control block diagram of the cooking device. As shown in FIG. 11, this cooking device includes a control unit 100 that has a microcomputer and input/output circuits. Based on an operation input signal from the operation panel 3 as well as detection signals of an exhaust duct temperature sensor 70, an interior temperature sensor 71 and a door opening/closing sensor 72, the control unit 100 controls the liquid crystal display part 7, the water supply pump 14, the cooling fan 16, the steam producing heater 24, the upper heater 26 and the lower heater 27. The control unit 100 further has a cooling-fan abnormal stop detection part 100*a* for detecting whether or not the cooling fan 16 is at an abnormal stop, based on a temperature of the atmosphere inside the exhaust duct 19 detected by the exhaust duct temperature sensor 70, a fan control part 100*b* for controlling operation of the cooling fan 16, and a cooking control part 100*c* for controlling cooking operation. The door opening/closing sensor 72 detects an opened/closed state of the door 2.

In the cooking device having the above configuration, the water supply tank 23 containing a required quantity of water is put in the tank housing part 15 with the door 2 drawn out as shown in FIG. 2B, and heat cooking with use of steam is thereafter started by an operation on the operation panel 3, with the door 2 closed. Then the upper heater 26 and the lower heater that are provided on the upper and lower sides of the heating chamber 8 are turned on, the water supply pump 14 is activated so as to supply water from the water supply tank 23 into the steam producing device 13, and steam is produced by heating of the water supplied into the steam producing device 13 by the steam producing heater 24. The steam produced by the steam producing device 13 blows out into the upper heater housing part 25 on the upper side in the heating chamber 8, and becomes superheated steam having a temperature not lower than 100° C. by being heated by the upper heater 26. The superheated steam is supplied into the heating chamber 8 through a plurality of holes provided on an upper cover (not shown) on a ceiling surface of the heating chamber 8. Thus food placed on the tray 32 in the heating chamber 8 is heated and cooked by radiant heat from the upper cover on the ceiling surface side of the heating chamber 8, radiant heat from the lower cover on bottom side thereof, and superheated steam that is blown out through the plurality of holes of the upper cover and that has the temperature not lower than 100° C. Then the superheated steam supplied to and deposited on surfaces of the food condenses on the surfaces of the food and gives the food a great quantity of latent heat of condensation and therefore heat can efficiently be transmitted to the food.

In the cooking device, oven cooking may be performed with use of only the upper heater 26 and the lower heater 27 and without use of steam, and steam cooking or the like may be performed with use of only steam produced by the steam producing device 13 and without use of the upper heater 26 and the lower heater 27.

According to the cooking device with the above-described construction, the exhaust duct 19 mixes exhaust air from the opening 61*a* of the nozzle part 61 with part of cooling air from the cooling fan 16 by wind pressure of cooling air from the cooling fan 16, and guides mixed air of the mixing to outside of the casing 1 so as to discharge the air outside. In this process, with the cooling fan 16 in normal operation, the atmosphere temperature inside the exhaust duct 19 detected by the exhaust duct temperature sensor 70 is generally equal to the temperature of the cooling air from the cooling fan 16, being far lower than exhaust air temperature from within the heating chamber 8. However, when the cooling fan 16 comes to an abnormal stop due to fault or the like, cooling air from the cooling fan 16 no longer flows into the exhaust duct 19, so that the air stream in the exhaust duct 19 stagnates while the exhaust air from within the heating chamber 8 continues flowing into the exhaust duct 19 via the exhaust tube 18 and the nozzle part 61. As a result, high-temperature exhaust air from the opening 61*a* of the nozzle part 61 goes upper than the inlet opening within the exhaust duct 19. Accordingly, the exhaust duct temperature sensor 70 placed in the exhaust duct 19 promptly detects an increase of the atmosphere temperature in part of inside of the exhaust duct 19 upper than the opening 61*a* of the nozzle part 61. Upon such an abnormal stop of the cooling fan 16, the atmosphere temperature inside the exhaust duct 19 detected by the exhaust duct temperature sensor 70 largely changes, so that the cooling fan abnormal-stop detection part 100*a* is enabled to securely and promptly detect an abnormal stop of the cooling fan 16. In this embodiment, the detection temperature by the exhaust duct temperature sensor 70 during normal operation of the cooling fan 16 is around 50° C., and the detection temperature by the exhaust duct temperature sensor 70 during an abnormal stop of the cooling fan 16 is about 80° C.

Therefore, according to this cooking device, an abnormal stop of the cooling fan 16 relating to exhaust can be detected promptly with simple construction without using a self-heating type thermistor. Also, by interrupting conduction to the heater or other electric components upon prompt detection of an abnormal stop of the cooling fan 16, the electric components can be prevented from being damaged due to temperature increases. Further, by detecting an abnormal stop of the cooling fan 16 and stopping the operation before deposition of steam or generation of dew condensations in the electric component chamber 9, damage to the electric components or the like can be prevented in advance.

In addition, the cooling fan 16 does not need to be operated under low interior temperature of the electric component chamber 9, and therefore is operated when the interior temperature of the electric component chamber 9 becomes high due to cooking.

The opening 61*a* of the nozzle part 61 is placed on a wind path between the blow-in opening 60 on the upstream side of the exhaust duct 19 and the discharge opening 22 on its downstream side, while the exhaust duct temperature sensor 70 is placed on the upstream side of the opening 61*a* of the nozzle part 61 within the exhaust duct 19. With this placement, a temperature of the cooling air flowing in from the cooling fan 16 is detected by the exhaust duct temperature sensor 70 during normal operation of the cooling fan 16. During an abnormal stop of the cooling fan 16, high-temperature exhaust air that has flowed in through the opening 61*a* of the nozzle part 61 moves toward the upstream side of the opening 61*a* of the nozzle part 61 within the exhaust duct 19, so that high-temperature exhaust air is detected by the exhaust duct temperature sensor 70. Thus, since a changing width of the atmosphere temperature inside the exhaust duct 19 detected by the exhaust duct temperature sensor 70 between normal operation and abnormal stop of the cooling fan 16 becomes larger, an abnormal stop of the cooling fan 16 can be detected more securely.

Moreover, since the upper surface of the exhaust duct 19 is inclined so as to gradually lower from upstream toward downstream side, high-temperature exhaust air that has flowed in through the opening 61*a* of the nozzle part 61 moves toward the upstream side along the upper surface within the exhaust duct 19 during an abnormal stop of the cooling fan 16. Thus, the high-temperature exhaust air that has moved can be detected more promptly by the exhaust duct temperature sensor 70.

In cooking with a food set in the heating chamber 8, when the interior of the heating chamber 8 is heated to such a high temperature that steam, smoke and the like are generated from the heated food so as to be filled in the heating chamber 8, exhaust air from within the heating chamber 8 is guided by the exhaust tube 18 to the front face side through the electric component chamber 9, which is a cooling space in the casing 1. Then, the dew receiving container 4, which is an exhaust receiving part provided on the front face side of the casing 1, receives the exhaust air from the exhaust port of the exhaust tube 18 and diffuses the air out of the casing 1. In this case, high-temperature exhaust air containing steam from within the heating chamber 8 is cooled during passage through the electric component chamber 9 within the casing 1 via the exhaust tube 18, so that the cooled exhaust air of lower temperature can be received by the dew receiving container 4 provided on the front face side and diffused to the broad outside space in front of the casing 1.

As a result of this, even when a wall surface is present near the rear face side of the cooking device body or a shelf is present immediately above the device body, in-chamber exhaust air is not discharged from the rear face side of the device body. Thus, it does not occur that high-heat exhaust air containing steam collides and causes corrosion of the wall surface or shelves, dense growth of mold and the like. Therefore, the cooking device, event when placed in a narrow space, is enabled to dispose of the exhaust air from within the heating chamber 8 without discharging the exhaust air from the rear face side thereof.

Also, since steam contained in the in-chamber exhaust air is condensed in the exhaust tube 18, the nozzle part 61 and the exhaust duct 19 before discharged to the front face side of the casing 1, dehumidified exhaust air can be released out to the outside space. Moreover, condensed water generated in the exhaust tube 18, the nozzle part 61 and the exhaust duct 19 can be collected by the dew receiving container 4. In this cooking device, the condensed water collected to the dew receiving container 4 is so small in quantity as to be air-dried, so that the time and labor for disposing of the water within the dew receiving container 4 can be saved. Since the exhaust air from within the heating chamber 8 is received once by the dew receiving container 4 and diffused out of the casing 1, there is no occurrence of blowing the exhaust air directly against the user, leading to improved comfortableness.

The above embodiment has been described on a cooking device for performing cooking with use of 100° C. or higher superheated steam. However, cooking with use of only heaters or cooking including steam cooking with use of steam and the like may be performed as cooking in which an object to be heated is heated in the heating chamber 8.

The exhaust air from inside of the heating chamber 8 is guided by the exhaust tube 18 from the rear part to the front face side of the heating chamber 8, and thus a path length of the exhaust tube 18 can be increased, so that cooling efficiency can be increased by the extension of the path running through the electric component chamber 9. Thus, the temperature of the exhaust air diffused to the outside of the casing 1 by the dew receiving container 4 can be further decreased.

Figure 9:
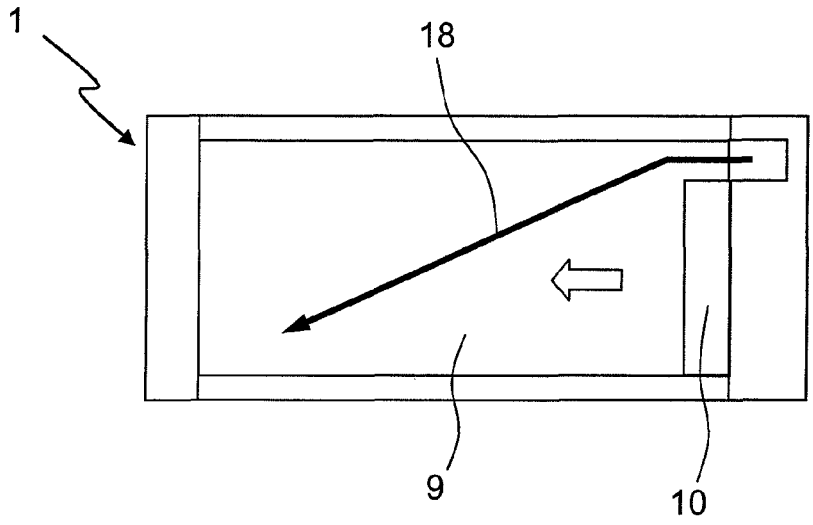
FIG. 9 is a schematic representation of the cooking device as seen looking from the lateral side thereof.

By inclination of the exhaust tube 18 from the rear part toward the front face side of the heating chamber 8 and from upper side of the rear part toward lower side of the front face side of the heating chamber 8, as shown in FIG. 9, the path running through the electric component chamber 9 that is the cooling space can be extended so that the cooling efficiency is improved, and condensate water that may be produced by cooling of highly heated exhaust containing steam in the electric component chamber 9 is made to flow down through the exhaust tube 18 toward the downstream side. This prevents stagnation of the condensate water in the exhaust tube 18, impediment against flow of the exhaust, and unsanitary condition in the exhaust tube 18.

Figure 10:
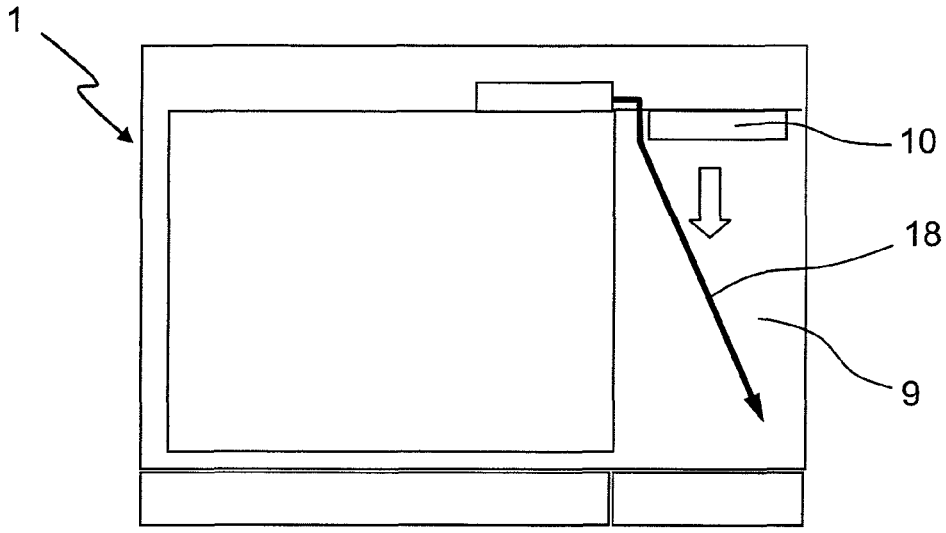
FIG. 10 is a schematic representation of the cooking device as seen looking from above.

As shown in FIG. 10, the exhaust tube 18 guides the exhaust from vicinity of the rear part of the heating chamber 8 toward the front face side to the outside, in the electric component chamber 9 that is the cooling space provided on the lateral side of the heating chamber 8, extending from the rear face side to the front face side of the heating chamber 8 in the casing 1, and thus the path length of the exhaust tube 18 can be increased. Thus, the cooling efficiency can be increased by the extension of the path running through the electric component chamber 9. Also, the temperature of the exhaust to be diffused to the outside of the casing 1 can further be decreased by the dew receiving container 4 that is the exhaust receiving part.

A portion of cooling air from the cooling fan 16 for cooling the electric components is blown into the upstream side blow-in opening 60 of the exhaust duct 19, which is provided in the casing 1 and on the front face side in the electric component chamber 9 that is the cooling space. The cooling air blown in the exhaust duct 19 through the blow-in opening 60 is guided by the top wall 19*a*, the bottom wall 19*b*, and the side wall 19*c* of the exhaust duct 19 and is discharged through the discharge port 22 provided on the downstream side. At this time, the exhaust flows into the exhaust duct 19 through the opening 61*a* of the nozzle part 61 provided in an air path between the blow-in opening 60 and the discharge port 22 in the exhaust duct 19 and is mixed with the cooling air, so that the exhaust diluted by mixing with the cooling air is discharged through the discharge port 22 of the exhaust duct 19. With such utilization of the cooling air from the cooling fan 16 for cooling the electric components, the temperature of the exhaust is allowed to be decreased by the dilution of the exhaust, and the exhaust from the inside of the heating chamber 8 can efficiently be discharged by smooth flow of the exhaust by way of the exhaust duct 19.

The dew receiving container 4 configured to receive water drops falling along the front face of the casing 1 is used as an exhaust receiving part for receiving an exhaust air from the exhaust tube 18 and diffusing the exhaust air to the outside. The dew receiving container 4, thus having both a function of receiving dew and a function of receiving and diffusing exhaust, makes it possible to simplify a structure of the device and to reduce manufacturing cost, cost of components and the like therefor.

Figure 12:
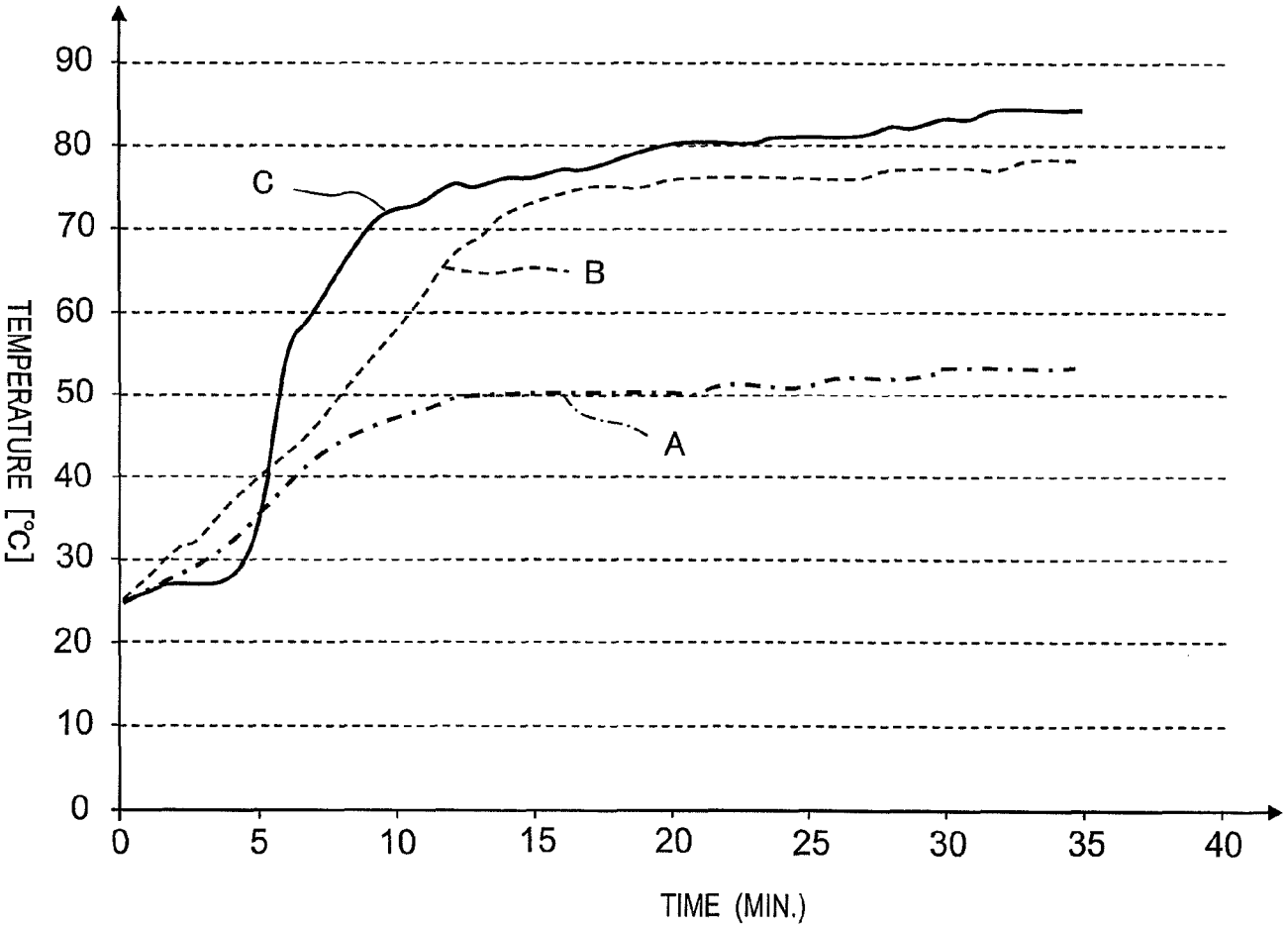
FIG. 12 shows variations in exhaust air temperature of the cooking device.

FIG. 12 shows variations in exhaust air temperature of the cooking device. In FIG. 12, the horizontal axis represents time (minute) from a start of cooking with use of steam, while the vertical axis represents atmosphere temperature (° C.) inside the exhaust duct 19 detected by the exhaust duct temperature sensor 70.

A curve A shown in FIG. 12 represents an atmosphere temperature inside the exhaust duct 19 during heating operation under a condition that the space around the cooking device is an opened space. A curve B represents an atmosphere temperature inside the exhaust duct 19 during heating operation under a condition that the cooking device is surrounded by wall surfaces, and a curve C represents an atmosphere temperature inside the exhaust duct 19 during heating operation under a condition that the cooking device is surrounded by wall surfaces and moreover the cooling fan 16 is stopped.

As an example, the condition of the curve C that the cooking device is surrounded by wall surfaces is that gap distances to the surrounding walls are 30 cm upward, 5 cm leftward, 5 cm rightward, open forward, 1.5 cm rearward, and 0 cm downward.

As shown by the curve A in FIG. 12, the atmosphere temperature profile inside the exhaust duct 19 under the condition that the surrounding space is opened shows a gentle slope of about 50° C.-53° C. On the other hand, as shown by the curve B, the atmosphere temperature inside the exhaust duct 19 under the condition that the cooking device is surrounded by wall surfaces shows a gentle slope of about 76° C.-78° C., higher than the curve A. As is apparent, variations in the atmosphere temperature inside the exhaust duct 19 during heating operation largely differs depending on ambient environmental conditions.

When the cooling fan 16 comes to an abnormal stop during heating operation, there arises an abrupt characteristic change from curve A or curve B to curve C, where the curve A is larger in temperature change than curve B.

In this cooking device, for heating operation with or without use of steam, the cooling fan 16 is kept stopped for 4 minutes from a start of heating operation.

After starting the cooking, when an increment per unit time of the atmosphere temperature inside the exhaust duct 19 detected by the exhaust duct temperature sensor 70 has become equal to or higher than a second threshold value, the fan control part 100*b* starts operation of the cooling fan 16. Therefore, at the time of cooking start, the cooling fan 16 is not rotated until after the temperature inside the heating chamber 8 increases enough, so that it is possible to achieve an energy saving and moreover securely suppress temperature decreases inside the heating chamber 8 due to the operation of the cooling fan 16 at the time of cooking start. For next cooking to be performed continuously subsequent to an end of cooking, since the temperature inside the heating chamber 8 has already become high, the cooling fan 16 can be immediately started to be operated.

It is also allowed that the fan control part 100*b* starts operation of the cooling fan 16 when the atmosphere temperature inside the exhaust duct 19 detected by the exhaust duct temperature sensor 70 after a start of cooking has become a fan operation-start decision temperature or more.

In this connection, it is also allowed that with use of decisions as to both conditions, i.e. a decision as to the condition using an increment per unit time of the atmosphere temperature inside the exhaust duct 19 and another decision as to the condition using a fan operation-start decision temperature, the fan control part 100*b* starts the operation of the cooling fan 16 when one or both of those two conditions are satisfied.

When the increment per unit time of the atmosphere temperature inside the exhaust duct 19 detected by the exhaust duct temperature sensor 70 during cooking becomes equal to or higher than a first threshold value, the cooling fan abnormal-stop detection part 100*a* detects an abnormal stop of the cooling fan 16. Thus, an abnormal stop of the cooling fan 16 can be detected securely.

In this embodiment, when the increment per unit time of the atmosphere temperature inside the exhaust duct 19 becomes the first threshold value or more consecutively two times, the cooling fan abnormal-stop detection part 100*a* detects an abnormal stop of the cooling fan 16. Thus, an abnormal stop of the cooling fan 16 can be detected more accurately, and its misdetections can be prevented.

Alternatively, an abnormal stop of the cooling fan 16 may also be detected when the atmosphere temperature inside the exhaust duct 19 detected by the exhaust duct temperature sensor 70 during cooking becomes equal to or higher than a fan abnormal-stop decision temperature (e.g., 90° C.).

In this connection, it is also allowed that with use of decisions as to both conditions, i.e. a decision as to the condition using an increment per unit time of the atmosphere temperature inside the exhaust duct 19 and another decision as to the condition using a fan abnormal-stop decision temperature, the cooling fan abnormal-stop detection part 100*a* detects an abnormal stop of the cooling fan 16 when one or both of those two conditions are satisfied.

Also in this embodiment, with temperatures of 72° C. or more set as a high temperature region and temperatures less than 72° C. set as a low temperature region, the first threshold value is set to 3° C. for the high temperature region and to 10° C. for the low temperature region.

In this case, the cooling fan abnormal-stop detection part 100*a* reads an atmosphere temperature inside the exhaust duct 19 at 10-second intervals by the exhaust duct temperature sensor 70, stores six pieces of temperature data for one minute until the current time into memory, and compares current temperature data with one-minute-ago temperature data to determine an increment per unit time (one minute). Then, when the current temperature data is in the high temperature region, the detection part 100*a* decides whether or not the increment per unit time is 3° C. (a first threshold value) or more. On the other hand, when the current temperature data is in the low temperature region, the detection part 100*a* decides whether or not the increment per unit time is 10° C. (a first threshold value) or more. The abnormal-stop decision of the cooling fan 16 is performed at 10-second intervals as shown above. And, if the increment per unit time of the atmosphere temperature inside the exhaust duct 19 is not less than the first threshold value, the error counter is incremented by +1. If the increment per unit time of the atmosphere temperature inside the exhaust duct 19 is less than the first threshold value, the error counter is cleared to zero. In this decision using the increment per unit time, temperature data stored in the memory or the error counter is cleared to zero when the door is opened during cooking.

As shown above, with use of first threshold values which are set for the two temperature regions, respectively, such that the first threshold values decrease with increasing temperature of the temperature regions, the cooling fan abnormal-stop detection part 100*a* determines an increment per unit time of the atmosphere temperature inside the exhaust duct 19 detected by the exhaust duct temperature sensor 70 during cooking. Thus, the cooling fan abnormal-stop detection part 100*a* makes a decision by using the larger first threshold value for the low temperature region showing larger changes in temperature rise at an abnormal stop of the cooling fan 16, while the detection part 100*a* makes a decision by using the smaller first threshold value for the high temperature region showing smaller changes in temperature rise at an abnormal stop of the cooling fan 16. Therefore, it becomes implementable to achieve an accurate decision for a wider temperature region of the atmosphere inside the exhaust duct 19.

In this embodiment, the temperatures are divided into two temperature regions of higher temperatures and lower temperatures, respectively. However, without being limited to this, first threshold values which are set for three or more temperature regions, respectively, may also be used to determine the increment per unit time of the atmosphere temperature inside the exhaust duct 19.

Also, when one-minute-ago temperature data (i.e., starting-point temperature) and current temperature data (i.e., terminating-point temperature), from which an increment per unit time of the atmosphere temperature inside the exhaust duct 19 detected by the exhaust duct temperature sensor 70 is determined, stretches over the two temperature regions, the cooling fan abnormal-stop detection part 100*a* uses the smaller one of the first threshold values set for the respective temperature regions, i.e. the first threshold value for the high temperature region, to detect an abnormal stop of the cooling fan 16. Therefore, since the cooling fan abnormal-stop detection part 100*a* makes a decision by using the first threshold value set for the high temperature region, which is smaller in change of temperature rise at an abnormal stop of the cooling fan 16, there can be achieved a more accurate decision.

Further, until after a first specified time (60 seconds in this embodiment) has elapsed after a start of cooking, the cooling fan abnormal-stop detection part 100*a* is inhibited from detecting an abnormal stop of the cooling fan 16. Therefore, even if the ambient environmental temperature has abruptly changed immediately before an operation start of cooking, misdetections of an abnormal stop of the cooling fan 16 can be prevented (e.g., in a case where cooking is performed with the cooking device moved from a cold place to a room-temperature environment).

Upon detection of an abnormal stop of the cooling fan 16 by the cooling fan abnormal-stop detection part 100*a*, if the atmosphere temperature inside the exhaust duct 19 detected by the exhaust duct temperature sensor 70 is not more than a cooking-operation-resumption decision temperature (40° C. in this embodiment), the cooking control part 100*c* resumes cooking operation. Therefore, it becomes implementable to complete the cooking to an end. In this case, in this embodiment, with the first specified time shortened to 1 second, the cooling fan abnormal-stop detection part 100*a* immediately executes the detection of an abnormal stop of the cooling fan 16.

Upon the detection of an abnormal stop of the cooling fan 16 by the cooling fan abnormal-stop detection part 100*a*, on the other hand, if the atmosphere temperature inside the exhaust duct 19 detected by the exhaust duct temperature sensor 70 is higher than the cooking-operation-resumption decision temperature (40° C. in this embodiment), the control unit 100 performs an error display on the liquid crystal display part 7 and then, after a specified time, interrupts the power supply.

Further, until after a third specified time (20 seconds in this embodiment) has elapsed after a change from an open to a closed state of the door 2 determined based on the door open/closed state detected by the door opening/closing sensor 72, the cooling fan abnormal-stop detection part 100*a* is inhibited from detecting an abnormal stop of the cooling fan 16. In opening/closing of the door during cooking, even if high-temperature exhaust air led from within the heating chamber 8 to the exhaust duct 19 at a closing of the door 2 causes the atmosphere temperature inside the exhaust duct 19 to be increased, misdetections of an abnormal stop of the cooling fan 16 by the cooling fan abnormal-stop detection part 100*a* can securely be prevented.

Figure 13:
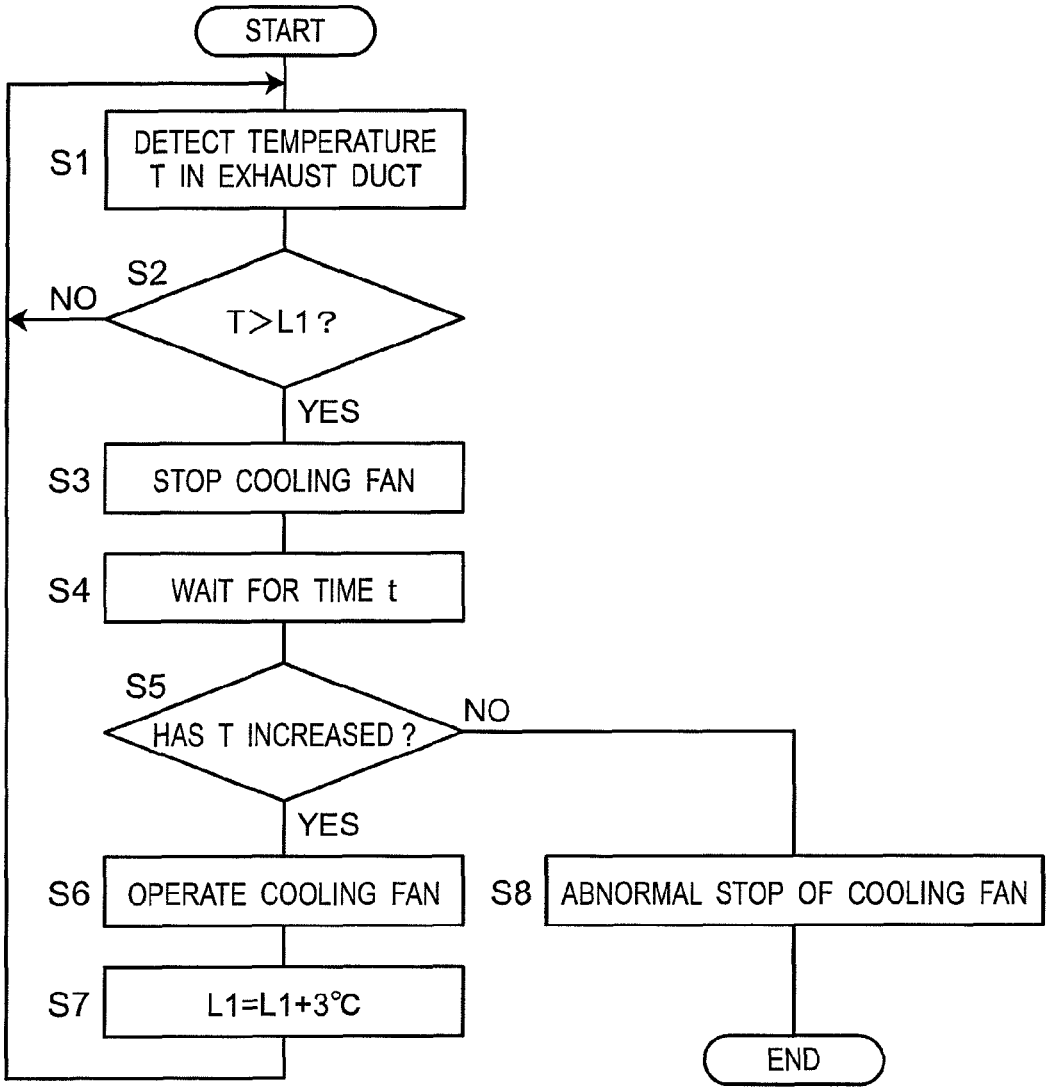
FIG. 13 is a flowchart for explaining the operation of detecting an abnormal stop of a cooling fan by a cooling fan abnormal-stop detection part in a cooking device according to another embodiment.

FIG. 13 is a flowchart for explaining the operation of detecting an abnormal stop of the cooling fan 16 by the cooling fan abnormal-stop detection part 100*a* in a cooking device according to another embodiment. In FIG. 13, a first-time abnormal-stop decision of the cooling fan is performed using the fan abnormal-stop decision temperature.

First, upon a start of processing, an atmosphere temperature T inside the exhaust duct 19 detected by the exhaust duct temperature sensor 70 is detected at step S1.

Next, the processing goes to step S2, where if it is decided that the atmosphere temperature T inside the exhaust duct 19 is higher than a fan abnormal-stop decision temperature L1, the processing goes to step S3. On the other hand, if it is decided that the atmosphere temperature T inside the exhaust duct 19 is lower than the fan abnormal-stop decision temperature L1, the processing returns to step S1.

Then, the cooling fan 16 is stopped by the fan control part 100*b* at step S3, and the processing goes to step S4; waiting for time t.

Next, at step S5, it is decided whether or not the temperature T has increased. That is, it is decided whether or not the increment of the atmosphere temperature inside the exhaust duct 19 in a period of a second specified time (a time period t starting from a stop of the cooling fan 16 by the fan control part 100*b*) has become equal to or higher than a third threshold value (3° C. in this embodiment).

Then, if it is decided at step S5 that the temperature T has increased, the processing goes to step S6, where the cooling fan 16 is activated.

Next, at step S7, the fan abnormal-stop decision temperature L1 is updated (L1=L1+3° C.), and the processing returns to step S1.

On the other hand, if it is decided at step S5 that the temperature T has not increased, the processing goes to step S8, where it is regarded as an abnormal stop of the cooling fan 16 and this processing is terminated, followed by processing for an abnormal stop of the cooling fan 16.

As shown above, in this cooking device, when the cooling fan abnormal-stop detection part 100*a* detects an abnormal stop of the cooling fan 16 during operation of the cooling fan 16, the cooling fan 16 is stopped by the fan control part 100*b*. Then, when the increment in a period of the second specified time of the atmosphere temperature inside the exhaust duct 19 detected by the exhaust duct temperature sensor 70 after the stop of the cooling fan 16 becomes equal to or higher than the third threshold value (3° C.), the cooling fan abnormal-stop detection part 100*a* decides that the stop of the cooling fan 16 is not an abnormal stop, and the operation of the cooling fan 16 is resumed by the fan control part 100*b*. Even if the cooling fan abnormal-stop detection part 100*a* detects an abnormal stop of the cooling fan 16, there are some cases where the cooling fan 16 is really not abnormally stopped, but normally working. In such a case, stopping the normally-operating cooling fan 16 by the fan control part 100*b* would cause the atmosphere temperature inside the exhaust duct 19 to be increased, where this temperature increase makes it found that the cooling fan 16 is not in an abnormal stop. Therefore, even if an abnormal stop of the cooling fan 16 is mis-detected, the cooling fan 16 can be continuously operated to perform the cooking.

When the cooling fan abnormal-stop detection part 100*a* detects an abnormal stop of the cooling fan 16 during operation of the cooling fan 16, the cooling fan 16 is stopped by the fan control part 100*b*. If the increment in a period of the second specified time of the atmosphere temperature inside the exhaust duct 19 detected by the exhaust duct temperature sensor 70 after the stop of the cooling fan 16 is less than the third threshold value, the cooling fan abnormal-stop detection part 100*a* decides that it is an abnormal stop of the cooling fan 16. Like this, in case of an abnormal stop of the cooling fan 16, the atmosphere temperature inside the exhaust duct 19 does not increase, showing little change. Thus, with confirmation that there is no such temperature increase, an abnormal stop of the cooling fan 16 can securely be detected.

The above embodiment has been described on a cooking device using the cooling fan 16 as a fan for feeding part of the air to the exhaust duct. However, the fan for feeding at least part of the air to the exhaust duct is not limited to this. For example, the invention may also be applied to cooking devices using an exhaust fan for feeding air to the exhaust duct.

Also, the embodiment has been described on a cooking device including exhaust paths (exhaust tube 18 and nozzle part 61) and the exhaust duct 19. However, the exhaust paths and the exhaust duct are not limited to this and may be replaced by, for example, an exhaust duct for exhausting from an upward-placed exhaust port via an exhaust path extending upward from the rear face side of the heating chamber.

The embodiment has been described on a cooking device using the exhaust duct 19. However, the exhaust duct is not limited to this, and needs only to be one in which exhaust air from the exhaust path and part (or all) of air from the fan are mixed together and discharged out of the casing.

The embodiment has been described on a cooking device using the dew receiving container 4 as an exhaust receiving part. However, the exhaust receiving part is not limited to this, and may be provided by a member other than the dew receiving container. The exhaust receiving part has only to receive the exhaust air from the exhaust port of the exhaust path and to diffuse the exhaust air to the outside of the casing.

In the embodiment, the opening 8*a* of the heating chamber 8 is opened and closed by the door 2 that slides in the frontward and rearward directions with respect to the casing 1. However, the opening of the heating chamber may also be opened and closed by, for example, a pivoting type opening/closing door. That is, the opening/closing door of the cooking device of the invention may be of slide type or pivoting type.

The cooking device of the invention may be implemented not only as a microwave oven using superheated steam but an oven using superheated steam, a microwave oven not using superheated steam, an oven not using superheated steam or the like, for instance.

Healthy cooking can be performed by use of superheated steam or saturated steam in a microwave oven or the like according to the cooking device of the invention.

In the cooking device of the invention, for instance, superheated steam or saturated steam having a temperature not lower than 100° C. is supplied onto surfaces of food, the superheated steam or saturated steam deposited onto the surfaces of the food condenses and gives the food a great quantity of latent heat of condensation, and therefore heat can efficiently be transmitted to the food. The condensate water is deposited on the surfaces of the food, and salt content, oil content and the like drop with the condensate water, so that salt content, oil content and the like in the food can be reduced. Furthermore, the heating chamber is filled with the superheated steam or saturated steam so as to be poor in oxygen, and thus cooking by which oxidation of the food is suppressed can be performed. Herein, a condition poor in oxygen refers to a condition in which volume percentage of oxygen is not more than 10% (e.g., 2-3%) in the heating chamber.

The invention also provides a cooking device comprising:

a casing;

a heating chamber placed in the casing;

an exhaust path configured and arranged to guide exhaust air from within the heating chamber to outside;

a cooling fan placed in the casing;

an exhaust duct configured and arranged to mix together exhaust air from the exhaust path and part of cooling air from the cooling fan and discharging the mixed air to outside of the casing;

a temperature sensor placed in the exhaust duct to detect a temperature of an atmosphere inside the exhaust duct at a portion upper than an inlet opening through which the exhaust air from the exhaust path flows into the exhaust duct; and a cooling fan abnormal-stop detection part configured and arranged to detect an abnormal stop of the cooling fan based on the temperature of the atmosphere inside the exhaust duct detected by the temperature sensor.

It is noted here that the cooling fan works for cooling at least part of electric components placed in the casing.

With this constitution, the exhaust duct mixes together exhaust air from the exhaust path and at least part of cooling air from the cooling fan and guides the mixed air to outside of the casing by wind pressure of the cooling air from the cooling fan. In this case, if the cooling fan is in normal operation, the atmosphere temperature inside the exhaust duct detected by the temperature sensor is generally equal to the temperature of the cooling air from the cooling fan, and far lower than the temperature of the exhaust air from within the heating chamber. However, upon an abnormal stop of the cooling fan due to a fault or the like, the cooling air from the cooling fan no longer flows into the exhaust duct, so that the air stream within the exhaust duct stagnates while the exhaust air from within the heating chamber continues to flow into the exhaust duct via the exhaust path, with the result that the high-temperature exhaust air from the exhaust path goes upper than the inlet opening within the exhaust duct. Therefore, the temperature sensor placed in the exhaust duct promptly detects an increase of the atmosphere temperature of part of inside of the exhaust duct upper than the inlet opening through which the exhaust air from the exhaust path flows into the exhaust duct. In such an abnormal stop of the cooling fan, the atmosphere temperature inside the exhaust duct detected by the temperature sensor changes to a large extent, making it possible for the cooling fan abnormal-stop detection part to securely and promptly detect an abnormal stop of the cooling fan.

Thus, an abnormal stop of the cooling fan can be detected promptly without use of a self-heating type thermistor and with a simple construction of the device. Also, by interrupting conduction to the heater or other electric components upon prompt detection of an abnormal stop of the cooling fan, the electric components can be prevented from being damaged due to temperature increases. Further, by stopping the operation before deposition of steam or generation of dew condensations on the electric components, damage to the electric components or the like can be prevented in advance.

In one embodiment, in the cooking device as described above, the exhaust duct has a blow-in opening, on an upstream side thereof, through which part of cooling air from the cooling fan blows into the exhaust duct, and a discharge opening, on a downstream side, through which the cooling air that has blown in through the blow-in opening is discharged outside, with the inlet opening for flow-in of the exhaust air from the exhaust path being placed in an air path between the blow-in opening and the discharge opening, and the temperature sensor is placed upstream of the inlet opening for flow-in of the exhaust air from the exhaust path in the exhaust duct.

According to this embodiment, by the arrangement that an inlet opening for flow-in of exhaust air from the exhaust path is placed in an air path between the upstream-side blow-in opening and the downstream-side discharge opening in the exhaust duct while the temperature sensor is placed upstream of the inlet opening for flow-in of the exhaust air from the exhaust path in the exhaust duct, a temperature of the cooling air that flows in from the cooling fan is detected by the temperature sensor during normal operation of the cooling fan, and high-temperature exhaust air, which has flowed in from the exhaust path and moved toward upstream of the inlet opening within the exhaust duct, is detected by the temperature sensor in an abnormal stop of the cooling fan. Therefore, the atmosphere temperature inside the exhaust duct detected by the temperature sensor shows a larger change between normal operation and abnormal stop of the cooling fan, making it possible to detect an abnormal stop of the cooling fan more securely.

Also in one embodiment, in the cooking device as described above, inner surfaces of the exhaust duct include an upper-side surface and a lower-side surface lower than the upper-side surface, and the upper-side surface of the exhaust duct is inclined so as to gradually lower from the upstream side toward the downstream side.

In this case, the exhaust duct may be formed into a quadrilateral or other polygonal shape in cross section, or a circular or elliptical shape in cross section, or other cross-sectional shape. With a quadrilateral or other polygonal cross-sectional shape, at least an uppermost surface out of inner surfaces of the exhaust duct forms the upper-side surface. With a circular or elliptical cross-sectional shape, at least an uppermost region out of the inner surface of the exhaust duct forms the upper-side surface.

According to this embodiment, by the arrangement that the upper-side surface of the exhaust duct is inclined so as to gradually lower in height from upstream side toward downstream side, high-temperature exhaust air that has flowed into the exhaust duct from the exhaust path easily moves toward the upstream side along the upper-side surface within the exhaust duct during an abnormal stop of the cooling fan. Thus, the high-temperature exhaust air that has moved can be detected promptly by the temperature sensor.

As is apparent from the above, the present invention realizes a cooking device that quickly detects an abnormal stop of the fan without use of a self-heating type thermistor and with a simple construction of the device.

Though the specific embodiments of the invention have been described, the invention is not limited to the embodiments described above and can be embodied with modification in various ways within the scope of the invention.

REFERENCE SIGNS LIST

1 casing
2 door with handle
3 operation panel
4 dew receiving container
5 dial
6 front leg
7 liquid crystal display part
8 heating chamber
9 electric component chamber
10 air intake space
11 heat shield plate
13 steam producing device
14 water supply pump
15 tank housing part
16 cooling fan
17 air intake
18 exhaust tube
19 exhaust duct
20 water supply tube
21 partition wall
22 discharge port
23 water supply tank
24 steam producing heater
25 upper heater housing part
26 upper heater
27 lower heater
70 exhaust duct temperature sensor
72 door opening/closing sensor
100 control unit
100*a* cooling-fan abnormal stop detection part
100*b* fan control part
100*c* cooking control part

The invention claimed is:

1. A cooking device comprising:
a casing;
a heating chamber placed in the casing;
a fan placed in the casing;
an exhaust path having one end connected to the heating chamber;
an exhaust duct configured and arranged to mix together exhaust air discharged from another end of the exhaust path and at least part of air from the fan and guide the mixed exhaust air to outside of the casing such that the mixed exhaust air is discharged outside;
a temperature sensor configured and arranged to detect an atmosphere temperature inside the exhaust duct; and
a fan abnormal-stop detection part configured and arranged to detect an abnormal stop of the fan when an increment per unit time of the atmosphere temperature inside the exhaust duct detected by the temperature sensor during cooking becomes equal to or higher than a first threshold value or when the atmosphere temperature inside the exhaust duct detected by the temperature sensor during cooking becomes equal to or higher than a fan abnormal-stop decision temperature, wherein
the fan abnormal-stop detection part is inhibited from detecting the abnormal stop of the fan until after a first specified time has passed after a start of cooking.

2. The cooking device as claimed in claim 1, wherein
the temperature sensor is configured and arranged to detect the atmosphere temperature inside the exhaust duct at a portion upper than an inlet opening through which the exhaust air from the exhaust path flows into the exhaust duct.

3. The cooking device as claimed in claim 2, wherein
the exhaust duct has a blow-in opening, on an upstream side thereof, through which at least part of air from the fan blows into the exhaust duct, and a discharge opening, on a downstream side thereof, through which the mixed exhaust air is discharged outside, with the inlet opening for flow-in of the exhaust air from the exhaust path being placed in an air path between the blow-in opening and the discharge opening, and
the temperature sensor is placed upstream of the inlet opening for flow-in of the exhaust air from the exhaust path in the exhaust duct.

4. The cooking device as claimed in claim 2, wherein
inner surfaces of the exhaust duct include an upper-side surface and a lower-side surface lower than the upper-side surface, and
the upper-side surface of the exhaust duct is inclined so as to gradually lower from the upstream side toward the downstream side.

5. The cooking device as claimed in claim 1, wherein
the first threshold value comprises a plurality of threshold values which are set for at least two temperature regions such that a first one of the plurality of threshold values is smaller than a second one of the plurality of threshold value for a lower temperature region.

6. The cooking device as claimed in claim 5, wherein
when a starting-point temperature and a terminating-point temperature, from which the increment per unit time of the atmosphere temperature inside the exhaust duct detected by the temperature sensor is determined, belong to different temperature regions, the fan abnormal-stop detection part uses a smallest one of the plurality of threshold values set for these temperature regions to detect the abnormal stop of the fan.

7. The cooking device as claimed in claim 1, further comprising:
a cooking control part that works such that when the abnormal stop of the fan is detected by the fan abnormal-stop detection part, if the atmosphere temperature inside the exhaust duct detected by the temperature sensor is not more than a cooking-operation-resumption decision temperature, the cooking control part resumes a cooking operation.

8. The cooking device as claimed in claim 1, further comprising:
a fan control part that controls the fan based on the atmosphere temperature inside the exhaust duct detected by the temperature sensor.

9. The cooking device as claimed in claim 8, wherein
the fan control part starts operation of the fan when the increment per unit time of the atmosphere temperature inside the exhaust duct detected by the temperature sensor after a start of cooking becomes equal to or higher than a second threshold value, or when the atmosphere temperature inside the exhaust duct detected by the temperature sensor after a start of cooking becomes equal to or higher than a fan-operation start decision temperature.

10. The cooking device as claimed in claim 8, wherein upon detection of the abnormal stop of the fan by the fan abnormal-stop detection part during operation of the fan, the fan is stopped by the fan control part, and when an increment in a period of a second specified time of the atmosphere temperature inside the exhaust duct detected by the temperature sensor after the stop of the fan is equal to or higher than a third threshold value, the fan abnormal-stop detection part decides that the stop of the fan is no abnormal stop and the fan control part resumes the operation of the fan.

11. The cooking device as claimed in claim 8, wherein upon detection of the abnormal stop of the fan by the fan abnormal-stop detection part during operation of the fan, the fan is stopped by the fan control part, and when an increment in a period of a second specified time of the atmosphere temperature inside the exhaust duct detected by the temperature sensor after the stop of the fan is less than a third threshold value, the fan abnormal-stop detection part decides that the stop of the fan is an abnormal stop.

12. The cooking device as claimed in claim 1, further comprising:

a door for opening and closing an opening of the heating chamber; and a door opening/closing sensor for detecting an opened/closed state of the door, wherein based on an opened/closed state of the door detected by the door opening/closing sensor, the fan abnormal-stop detection part is inhibited from detecting the abnormal stop of the fan until after a third specified time has elapsed after there was a change from an opened to a closed state of the door.

13. A cooking device comprising:

a casing;

a heating chamber placed in the casing;

a fan placed in the casing;

an exhaust path having one end connected to the heating chamber;

an exhaust duct configured and arranged to mix together exhaust air discharged from another end of the exhaust path and at least part of air from the fan and guide the mixed exhaust air to outside of the casing such that the mixed exhaust air is discharged outside;

a temperature sensor configured and arranged to detect an atmosphere temperature inside the exhaust duct; and a fan abnormal-stop detection part configured and arranged to detect an abnormal stop of the fan when an increment per unit time of the atmosphere temperature inside the exhaust duct detected by the temperature sensor during cooking becomes equal to or higher than a first threshold value or when the atmosphere temperature inside the exhaust duct detected by the temperature sensor during cooking becomes equal to or higher than a fan abnormal-stop decision temperature, further comprising:

a fan control part that controls the fan based on the atmosphere temperature inside the exhaust duct detected by the temperature sensor.

14. The cooking device as claimed in claim 13, wherein the fan control part starts operation of the fan when the increment per unit time of the atmosphere temperature inside the exhaust duct detected by the temperature sensor after a start of cooking becomes equal to or higher than a second threshold value, or when the atmosphere temperature inside the exhaust duct detected by the temperature sensor after a start of cooking becomes equal to or higher than a fan-operation start decision temperature.

15. The cooking device as claimed in claim 13, wherein upon detection of the abnormal stop of the fan by the fan abnormal-stop detection part during operation of the fan, the fan is stopped by the fan control part, and when an increment in a period of a second specified time of the atmosphere temperature inside the exhaust duct detected by the temperature sensor after the stop of the fan is equal to or higher than a third threshold value, the fan abnormal-stop detection part decides that the stop of the fan is no abnormal stop and the fan control part resumes the operation of the fan.

16. The cooking device as claimed in claim 13, wherein upon detection of the abnormal stop of the fan by the fan abnormal-stop detection part during operation of the fan, the fan is stopped by the fan control part, and when an increment in a period of a second specified time of the atmosphere temperature inside the exhaust duct detected by the temperature sensor after the stop of the fan is less than a third threshold value, the fan abnormal-stop detection part decides that the stop of the fan is an abnormal stop.

17. The cooking device as claimed in claim 13, wherein the temperature sensor is configured and arranged to detect the atmosphere temperature inside the exhaust duct at a portion upper than an inlet opening through which the exhaust air from the exhaust path flows into the exhaust duct.

18. The cooking device as claimed in claim 17, wherein the exhaust duct has a blow-in opening, on an upstream side thereof, through which at least part of air from the fan blows into the exhaust duct, and a discharge opening, on a downstream side thereof, through which the mixed exhaust air is discharged outside, with the inlet opening for flow-in of the exhaust air from the exhaust path being placed in an air path between the blow-in opening and the discharge opening, and the temperature sensor is placed upstream of the inlet opening for flow-in of the exhaust air from the exhaust path in the exhaust duct.

19. The cooking device as claimed in claim 17, wherein inner surfaces of the exhaust duct include an upper-side surface and a lower-side surface lower than the upper-side surface, and the upper-side surface of the exhaust duct is inclined so as to gradually lower from the upstream side toward the downstream side.

* * * * *